US009840909B2

(12) United States Patent
Lee et al.

(10) Patent No.: US 9,840,909 B2
(45) Date of Patent: Dec. 12, 2017

(54) FLOW BYPASS SLEEVE FOR A FLUID PRESSURE PULSE GENERATOR OF A DOWNHOLE TELEMETRY TOOL

(71) Applicant: EVOLUTION ENGINEERING INC., Calgary (CA)

(72) Inventors: Gavin Gaw-Wae Lee, Calgary (CA); Justin C. Logan, Calgary (CA); Aaron W. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 15/320,507

(22) PCT Filed: Jun. 25, 2015

(86) PCT No.: PCT/CA2015/050586
§ 371 (c)(1),
(2) Date: Dec. 20, 2016

(87) PCT Pub. No.: WO2015/196288
PCT Pub. Date: Dec. 30, 2015

(65) Prior Publication Data

US 2017/0248010 A1 Aug. 31, 2017

Related U.S. Application Data

(60) Provisional application No. 62/016,890, filed on Jun. 25, 2014.

(51) Int. Cl.
*E21B 47/18* (2012.01)

(52) U.S. Cl.
CPC ..... *E21B 47/187* (2013.01)

(58) Field of Classification Search
USPC ..... 367/83; 175/48
See application file for complete search history.

(56) References Cited

U.S. PATENT DOCUMENTS 3,739,331 A 6/1973 Godbey et al.
4,914,637 A 4/1990 Goodsman
(Continued)

FOREIGN PATENT DOCUMENTS

CA 1228909 11/1987
CA 1268052 4/1990
(Continued)

OTHER PUBLICATIONS

The International Search Report and Written Opinion dated Sep. 18, 2015, in PCT/CA2015/050587, filed Jun. 25, 2015.
(Continued)

*Primary Examiner* — Albert Wong
(74) *Attorney, Agent, or Firm* — Hovey Williams LLP

(57) ABSTRACT

A flow bypass sleeve for a fluid pressure pulse generator of a downhole telemetry tool. The fluid pressure pulse generator comprising a stator having one or more flow channels or orifices through which drilling fluid flows and a rotor which rotates relative to the stator to move in and out of fluid communication with the flow channels or orifices to create fluid pressure pulses in the drilling fluid flowing through the fluid pressure pulse generator. The flow bypass sleeve is configured to attach to a drill collar which housing the telemetry tool and comprises a body with a bore therethrough which receives the fluid pressure pulse generator. The body includes at least one longitudinally extending bypass channel comprising a groove longitudinally extending along an internal surface of the body or an aperture longitudinally extending through the body. The bypass channel extends across at least a portion of both the stator and the rotor when the fluid pressure pulse generator is received in the flow bypass sleeve such that the drilling fluid flows along the bypass channel as well as flowing through the flow channels or orifices. The bypass channel diverts drilling fluid
(Continued)

around the fluid pressure pulse generator and may be dimensioned to control the amount of drilling fluid being diverted.

25 Claims, 24 Drawing Sheets

(56) References Cited

U.S. PATENT DOCUMENTS

| | | | |
|---|---|---|---|
| 5,357,483 | A | 10/1994 | Innes |
| 5,586,083 | A | 12/1996 | Chin et al. |
| 5,636,178 | A | 6/1997 | Ritter |
| 5,740,126 | A | 4/1998 | Chin et al. |
| 7,083,008 | B2 | 8/2006 | Thorp et al. |
| 7,133,325 | B2 | 11/2006 | Kotsonis et al. |
| 7,230,880 | B2 | 6/2007 | Lehr |
| 8,020,632 | B2 | 9/2011 | Moriarty |
| 8,138,943 | B2 | 3/2012 | Kusko et al. |
| 8,151,905 | B2 | 4/2012 | Song |
| 8,181,719 | B2 | 5/2012 | Bunney et al. |
| 2009/0266544 | A1 | 10/2009 | Redlinger et al. |
| 2011/0280105 | A1 | 11/2011 | Hall et al. |
| 2014/0028293 | A1 | 1/2014 | Johnson et al. |

FOREIGN PATENT DOCUMENTS

| | | |
|---|---|---|
| CA | 1299998 | 5/1992 |
| CA | 2174017 | 10/1996 |
| CA | 2098676 | 11/1997 |
| CA | 2528999 | 9/2009 |
| CA | 2506912 | 7/2013 |
| CA | 2855930 | 5/2014 |
| CN | 203271731 | 11/2013 |
| CN | 203452776 | 2/2014 |
| CN | 103410503 | 6/2016 |
| GB | 2271790 | 2/1996 |
| GB | 2443096 | 10/2008 |
| WO | 2014/071514 | 5/2014 |

OTHER PUBLICATIONS

The International Search Report and Written Opinion dated Sep. 23, 2015, in PCT/CA2015/050586, filed Jun. 25, 2015.

The International Search Report and Written Opinion dated Sep. 22, 2015, in PCT/CA2015/050576, filed Jun. 22, 2015.

The International Search Report and Written Opinion dated Jan. 17, 2017, in PCT/CA2016/051298, filed Nov. 8, 2016.

FLOW BYPASS SLEEVE FOR A FLUID PRESSURE PULSE GENERATOR OF A DOWNHOLE TELEMETRY TOOL

RELATED APPLICATIONS

This is a national stage application under 35 U.S.C. §371 of International Patent Application No. PCT/CA2015/050586, filed Jun. 25, 2015, which claims benefit of U.S. Provisional Patent Application No. 62/016,890, filed Jun. 25, 2014, both of which are incorporated by reference in their entireties.

FIELD

This invention relates generally to a flow bypass sleeve for use with a fluid pressure pulse generator of a downhole telemetry tool, such as a mud pulse telemetry measurement-while-drilling ("MWD") tool.

BACKGROUND

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling "mud" that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering a well from vertical to intersect a target endpoint or follow a prescribed path. At the terminal end of the drill string is a bottom-hole-assembly ("BHA") which comprises 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface; and 5) other control equipment such as stabilizers or heavy weight drill collars. The BHA is conveyed into the wellbore by a string of metallic tubulars (i.e. drill pipe). MWD equipment is used to provide downhole sensor and status information to surface while drilling in a near real-time mode. This information is used by a rig crew to make decisions about controlling and steering the well to optimize the drilling speed and trajectory based on numerous factors, including lease boundaries, existing wells, formation properties, and hydrocarbon size and location. The rig crew can make intentional deviations from the planned wellbore path as necessary based on the information gathered from the downhole sensors during the drilling process. The ability to obtain real-time MWD data allows for a relatively more economical and more efficient drilling operation.

One type of downhole MWD telemetry known as mud pulse telemetry involves creating pressure waves ("pulses") in the drill mud circulating through the drill string. Mud is circulated from surface to downhole using positive displacement pumps. The resulting flow rate of mud is typically constant. The pressure pulses are achieved by changing the flow area and/or path of the drilling fluid as it passes the MWD tool in a timed, coded sequence, thereby creating pressure differentials in the drilling fluid. The pressure differentials or pulses may be either negative pulses or positive pulses. Valves that open and close a bypass stream from inside the drill pipe to the wellbore annulus create a negative pressure pulse. All negative pulsing valves need a high differential pressure below the valve to create a sufficient pressure drop when the valve is open, but this results in the negative valves being more prone to washing. With each actuation, the valve hits against the valve seat and needs to ensure it completely closes the bypass; the impact can lead to mechanical and abrasive wear and failure. Valves that use a controlled restriction within the circulating mud stream create a positive pressure pulse. Pulse frequency is typically governed by pulse generator motor speed changes. The pulse generator motor requires electrical connectivity with the other elements of the MWD probe.

One type of valve mechanism used to create mud pulses is a rotor and stator combination where a rotor can be rotated relative to the stator between an open flow position where there is no restriction of mud flowing through the valve and no pulse is generated, and a restricted flow position where there is restriction of mud flowing through the valve and a pressure pulse is generated.

SUMMARY

According to a first aspect, there is provided a flow bypass sleeve for a fluid pressure pulse generator of a downhole telemetry tool, the fluid pressure pulse generator comprising a stator having one or more flow channels or orifices through which drilling fluid flows and a rotor which rotates relative to the stator to move in and out of fluid communication with the flow channels or orifices to create fluid pressure pulses in the drilling fluid flowing through the flow channels or orifices, wherein the flow bypass sleeve is configured to fit inside a drill collar which houses the telemetry tool and comprises a body with a bore therethrough which receives the fluid pressure pulse generator, the body including at least one longitudinally extending bypass channel comprising a groove longitudinally extending along an internal surface of the body or an aperture longitudinally extending through the body, wherein the bypass channel extends across at least a portion of both the stator and the rotor when the fluid pressure pulse generator is received in the bore such that the drilling fluid flows along the bypass channel in addition to flowing through the flow channels or orifices of the stator.

According to a second aspect, there is provided a flow bypass sleeve for a fluid pressure pulse generator of a downhole telemetry tool. The fluid pressure pulse generator comprises a stator having one or more flow channels or orifices through which drilling fluid flows and a rotor which rotates relative to the stator to move in and out of fluid communication with the flow channels or orifices to create fluid pressure pulses in the drilling fluid flowing through the flow channels or orifices. The flow bypass sleeve is configured to fit inside a drill collar which housing the telemetry tool and comprises a body with a bore therethrough which receives the fluid pressure pulse generator. The body includes at least one longitudinally extending bypass channel with an uphole axial channel inlet and a downhole axial channel outlet. The bypass channel extends across at least a portion of both the stator and the rotor when the fluid pressure pulse generator is received in the bore such that the drilling fluid flows along the bypass channel in addition to flowing through the flow channels or orifices of the stator.

The flow bypass sleeve may comprise a plurality of bypass channels comprising at least one groove longitudinally extending along an internal surface of the body and at least one aperture longitudinally extending through the body.

The body may comprise an uphole section, a downhole section and a central section positioned therebetween. The diameter of the bore in the central section of the body may be less than the diameter of the bore in the uphole and downhole sections of the body. The at least one bypass channel may comprise a channel inlet and a channel outlet. The at least one bypass channel may extend longitudinally through the central section of the body and the channel inlet may be in fluid communication with the bore in the uphole section of the body and the channel outlet may be in fluid communication with the bore in the downhole section of the body. The uphole section of the body may taper in the uphole direction. The downhole section of the body may taper in the downhole direction. The bypass channel may comprise a groove longitudinally extending along an internal surface of the central section of the body. The bypass channel may comprise an aperture longitudinally extending through the central section of the body. The flow bypass sleeve may comprise a plurality of bypass channels comprising at least one groove longitudinally extending along an internal surface of the central section of the body and at least one aperture longitudinally extending through the central section of the body. The downhole section of the body may include at least one downhole groove longitudinally extending along an internal surface thereof. The downhole groove may have an uphole axial groove inlet and a downhole axial groove outlet. The groove inlet may be fluidly connected to the channel outlet of the aperture.

An external surface of the body may comprise a first portion and a second portion. An external circumference of the first portion may be less than an external circumference of the second portion. The flow bypass sleeve may further comprise an outer sleeve which surrounds the first portion of the body. An external surface of the outer sleeve may be flush with an external surface of the second portion of the body. The outer sleeve may comprise a first material and the second portion of the body may comprise a second material with a thermal expansion coefficient that is different to a thermal expansion coefficient of the first material. The outer sleeve may be positioned downstream to the second portion of the body. The outer sleeve may be axially adjacent the second portion of the body. The outer sleeve may be releasably positioned on the first portion of the body.

The external surface of the body may further comprise a third portion with an external circumference less than the external circumference of the second portion. The third portion may be configured to be inserted in a keying ring fitted in the drill collar. A keying mechanism on an external surface of the flow bypass sleeve may be configured to mate with a keying mechanism on the keying ring to align the flow bypass sleeve within the drill collar.

The external surface of the body may further comprise a third portion with an external circumference less than the external circumference of the second portion, wherein the third portion is configured to be inserted in a mounting ring in the drill collar to mount the flow bypass sleeve in the drill collar. The flow bypass sleeve may further comprise an alignment mechanism configured to mate with an alignment mechanism on the mounting ring to align the flow bypass sleeve within the drill collar.

The third portion may be axially adjacent and upstream to the second portion of the body.

The flow bypass sleeve may further comprise a longitudinally extending bypass channel insert releasably positioned in the bypass channel to reduce a flow area of the bypass channel. The body may include a plurality of longitudinally extending bypass channels and a plurality of longitudinally extending bypass channel inserts may be releasably positioned in the plurality of bypass channels to reduce the total flow area of the bypass channels.

The bypass channel may comprise the aperture and the bypass channel insert may comprise a tubular insert with an insert aperture therethrough. The flow bypass sleeve may further comprise a longitudinally extending tubular insert releasably positioned in the aperture to reduce a flow area of the aperture. The body may include a plurality of longitudinally extending apertures therethrough and a plurality of longitudinally extending tubular inserts may be releasably positioned in the plurality of apertures to reduce the total flow area of the apertures. The tubular insert may have an uphole shoulder section with an external circumference greater than an internal circumference of the aperture and a downhole edge of the shoulder section may abut an internal surface of the body when the tubular insert is positioned in the aperture. The flow bypass sleeve may further comprise a retaining ring releasably attached to the tubular insert to releasably retain the tubular insert in the aperture. The flow bypass sleeve may further comprise a fastener to releasably retain the bypass channel insert in the aperture.

According to another aspect, there is provided a kit comprising a fluid pressure pulse generator of a downhole telemetry tool and a plurality of flow bypass sleeves according to the first or second aspect. The plurality of flow bypass sleeves each have a different outer circumference such that each of the plurality of flow bypass sleeves can be received in a different sized drill collar.

According to another aspect, there is provided a kit comprising a fluid pressure pulse generator of a downhole telemetry tool and a first and second flow bypass sleeve according to the first or second aspect. The first flow bypass sleeve has a greater outer circumference compared to the outer circumference of the second flow bypass sleeve such that the first flow bypass sleeve can be received in a first drill collar and the second flow bypass sleeve can be received in a second drill collar whereby the internal diameter of the first drill collar is greater than the internal diameter of the second drill collar.

According to another aspect, there is provided a kit comprising a fluid pressure pulse generator of a downhole telemetry tool and a first and second flow bypass sleeve according to the first or second aspect. The first and second flow bypass sleeve both have corresponding internal dimensions configured to receive the fluid pressure pulse generator and the first flow bypass sleeve has a greater outer circumference compared to the outer circumference of the second flow bypass sleeve such that the first flow bypass sleeve can be received in a first drill collar and the second flow bypass sleeve can be received in a second drill collar whereby the internal diameter of the first drill collar is greater than the internal diameter of the second drill collar.

A total flow area of the at least one bypass channel of the first flow bypass sleeve may be greater than a total flow area of the at least one bypass channel of the second flow bypass sleeve.

According to another aspect, there is provided a kit comprising a fluid pressure pulse generator of a downhole telemetry tool and a plurality of flow bypass sleeves according to the first or second aspect. A total flow area of the at least one bypass channel is different for each of the plurality of flow bypass sleeves.

According to another aspect, there is provided a kit comprising a fluid pressure pulse generator of a downhole telemetry tool and a first and second flow bypass sleeve according to the first or second aspect. A total flow area of the at least one bypass channel of the first flow bypass sleeve is different to a total flow area of the at least one bypass channel of the second flow bypass sleeve.

According to another aspect, there is provided a kit comprising a fluid pressure pulse generator of a downhole telemetry tool, the flow bypass sleeve according to the first or second aspect, and a longitudinally extending bypass channel insert that can be releasably positioned in the bypass channel to reduce a flow area of the bypass channel.

The body of the sleeve may include a plurality of longitudinally extending bypass channels and the kit may comprise a plurality of longitudinally extending bypass channel inserts that can be releasably positioned in the plurality of bypass channels to reduce the total flow area of the bypass channels.

According to another aspect, there is provided a kit comprising a fluid pressure pulse generator of a downhole telemetry tool, the flow bypass sleeve according to the first or second aspect, and a longitudinally extending tubular insert that can be releasably positioned in the aperture to reduce a flow area of the aperture.

The body may include a plurality of longitudinally extending apertures therethrough and the kit may comprise a plurality of longitudinally extending tubular inserts that can be releasably positioned in the plurality of apertures to reduce the total flow area of the apertures. The tubular insert may have an uphole shoulder section with an external circumference greater than an internal circumference of the aperture and a downhole edge of the shoulder section may abut an internal surface of the body when the tubular insert is positioned in the aperture. The kit may further comprise a retaining ring that can be releasably attached to the tubular insert to releasably retain the tubular insert in the aperture.

According to another aspect, there is provided a kit comprising a fluid pressure pulse generator of a downhole telemetry tool and a flow bypass sleeve. The fluid pressure pulse generator comprises a stator and a rotor. The stator has a stator body and a plurality of radially extending stator projections spaced around the stator body, whereby adjacently spaced stator projections define stator flow channels extending therebetween. The rotor has a rotor body and a plurality of radially extending rotor projections spaced around the rotor body. The rotor projections are axially adjacent the stator projections and the rotor is rotatable relative to the stator such that the rotor projections move in and out of fluid communication with the stator flow channels to create fluid pressure pulses in drilling fluid flowing through the stator flow channels. The flow bypass sleeve comprises a sleeve body with a bore therethrough which receives the fluid pressure pulse generator. The sleeve body includes at least one longitudinally extending bypass channel with an uphole axial channel inlet and a downhole axial channel outlet. The bypass channel extends across both the stator projections and the rotor projections when the fluid pressure pulse generator is received in the bore, such that the drilling fluid flows along the bypass channel in addition to flowing through the stator flow channels.

The bypass channel may comprise a groove longitudinally extending along an internal surface of the sleeve body. The bypass channel may comprise an aperture longitudinally extending through the sleeve body. The sleeve body may include a plurality of bypass channels comprising at least one groove longitudinally extending along an internal surface of the sleeve body and at least one aperture longitudinally extending through the sleeve body.

The sleeve body may comprise an uphole section, a downhole section and a central section positioned therebetween. The diameter of the bore in the central section of the sleeve body may be less than the diameter of the bore in the uphole and downhole sections of the sleeve body. The at least one bypass channel may extend longitudinally through the central section of the sleeve body and the channel inlet may be in fluid communication with the bore in the uphole section of the sleeve body and the channel outlet may be in fluid communication with the bore in the downhole section of the sleeve body. The uphole section of the sleeve body may taper in the uphole direction. The downhole section of the sleeve body may taper in the downhole direction. The bypass channel may comprise a groove longitudinally extending along an internal surface of the central section of the sleeve body. The bypass channel may comprise an aperture longitudinally extending through the central section of the sleeve body. The sleeve body may include a plurality of bypass channels comprising at least one groove longitudinally extending along an internal surface of the central section of the sleeve body and at least one aperture longitudinally extending through the central section of the sleeve body. The downhole section of the sleeve body may include at least one downhole groove longitudinally extending along an internal surface thereof. The downhole groove may have an uphole axial groove inlet and a downhole axial groove outlet and the groove inlet may be fluidly connected to the channel outlet of the aperture.

An external surface of the sleeve body may comprise a first portion and a second portion. An external circumference of the first portion may be less than an external circumference of the second portion. The flow bypass sleeve may further comprise an outer sleeve which surrounds the first portion of the sleeve body. An external surface of the outer sleeve may be flush with an external surface of the second portion of the sleeve body. The outer sleeve may comprise a first material and the second portion of the sleeve body may comprise a second material with a thermal expansion coefficient that is different to a thermal expansion coefficient of the first material. The outer sleeve may be positioned downstream to the second portion of the sleeve body. The outer sleeve may be axially adjacent the second portion of the sleeve body. The outer sleeve may be releasably positioned on the first portion of the sleeve body.

The external surface of the sleeve body may further comprise a third portion with an external circumference less than the external circumference of the second portion. The third portion may be configured to be inserted in a keying ring fitted in the drill collar. A keying mechanism on an external surface of the flow bypass sleeve may be configured to mate with a keying mechanism on the keying ring to align the flow bypass sleeve within the drill collar. The third portion may be axially adjacent and upstream to the second portion of the sleeve body.

The kit may comprise a plurality of flow bypass sleeves. Each of the flow bypass sleeves may have a different outer circumference such that each of the flow bypass sleeves can be received in a different sized drill collar. A total cross sectional area for the at least one bypass channel may be different for each of the plurality of flow bypass sleeves, such that a volume of the drilling fluid that can flow along the bypass channel is different for each of the plurality of flow bypass sleeves.

The kit may further comprise a longitudinally extending bypass channel insert that can be releasably positioned in the bypass channel to reduce a flow area of the bypass channel. The sleeve body may include a plurality of longitudinally extending bypass channels and the kit may comprise a plurality of longitudinally extending bypass channel inserts that can be releasably positioned in the plurality of bypass channels to reduce the total flow area of the bypass channels.

The kit may further comprise a longitudinally extending tubular insert that can be releasably positioned in the aperture to reduce a flow area of the aperture. The sleeve body may include a plurality of longitudinally extending apertures therethrough and the kit may comprise a plurality of longitudinally extending tubular inserts that can be releasably positioned in the plurality of apertures to reduce the total flow area of the apertures. The tubular insert may have an uphole shoulder section with an external circumference greater than an internal circumference of the aperture and a downhole edge of the shoulder section may abut an internal surface of the sleeve body when the tubular insert is positioned in the aperture. The kit may further comprise a retaining ring that can be releasably attached to the tubular insert to releasably retain the tubular insert in the aperture.

According to another aspect, there is provided a downhole telemetry tool comprising: a pulser assembly comprising a housing enclosing a driveshaft; a fluid pressure pulse generator apparatus; and the flow bypass sleeve of the first or second aspect. The fluid pressure pulse generator comprises: a stator having a stator body and a plurality of radially extending stator projections spaced around the stator body, whereby adjacently spaced stator projections define stator flow channels extending therebetween; and a rotor coupled to the driveshaft and having a rotor body and a plurality of radially extending rotor projections spaced around the rotor body. The rotor projections are axially adjacent the stator projections and the rotor is rotatable relative to the stator such that the rotor projections move in and out of fluid communication with the stator flow channels to create fluid pressure pulses in drilling fluid flowing through the stator flow channels. The fluid pressure pulse generator is received in the bore of the flow bypass sleeve and the bypass channel extends across both the stator projections and the rotor projections, such that the drilling fluid flows along the bypass channel in addition to flowing through the stator flow channels.

According to another aspect, there is provided a downhole telemetry tool comprising: a fluid pressure pulse generator comprising a stator having one or more flow channels or orifices through which drilling fluid flows and a rotor which rotates relative to the stator to move in and out of fluid communication with the flow channels or orifices to create fluid pressure pulses in the drilling fluid flowing through the flow channels or orifices; and the flow bypass sleeve of the first or second aspect wherein the fluid pressure pulse generator is received in the bore of the body of the flow bypass sleeve and the bypass channel extends across at least a portion of both the stator and the rotor such that the drilling fluid flows along the bypass channel in addition to flowing through the flow channels or orifices of the stator.

This summary does not necessarily describe the entire scope of all aspects. Other aspects, features and advantages will be apparent to those of ordinary skill in the art upon review of the following description of specific embodiments.

DETAILED DESCRIPTION OF EMBODIMENTS OF THE INVENTION

Directional terms such as "uphole" and "downhole" are used in the following description for the purpose of providing relative reference only, and are not intended to suggest any limitations on how any apparatus is to be positioned during use, or to be mounted in an assembly or relative to an environment.

The embodiments described herein generally relate to a flow bypass sleeve for use with a fluid pressure pulse generator of a downhole telemetry tool. The fluid pressure pulse generator may be used for mud pulse ("MP") telemetry used in downhole drilling, where a drilling fluid (herein referred to as "mud") is used to transmit telemetry pulses to surface. The fluid pressure pulse generator includes a stator with flow channels or orifices through which mud flows and a rotor which rotates relative to the stator thereby allowing and restricting flow of the mud through the flow channels or orifices to create pressure pulses in the mud. The flow bypass sleeve is configured to be fitted inside a drill collar which houses the downhole telemetry tool. The flow bypass sleeve comprises a body with a bore therethrough which receives the fluid pressure pulse generator therein. The body includes one or more longitudinally extending bypass channels and mud flows along the bypass channels in addition to mud flowing through the stator flow channels or orifices. In this way the bypass channels divert mud around the fluid pressure pulse generator and the bypass channels may be dimensioned to control the amount of mud that is diverted and thus the amount of mud that flows through the stator flow channels or orifices.

Figure 1:
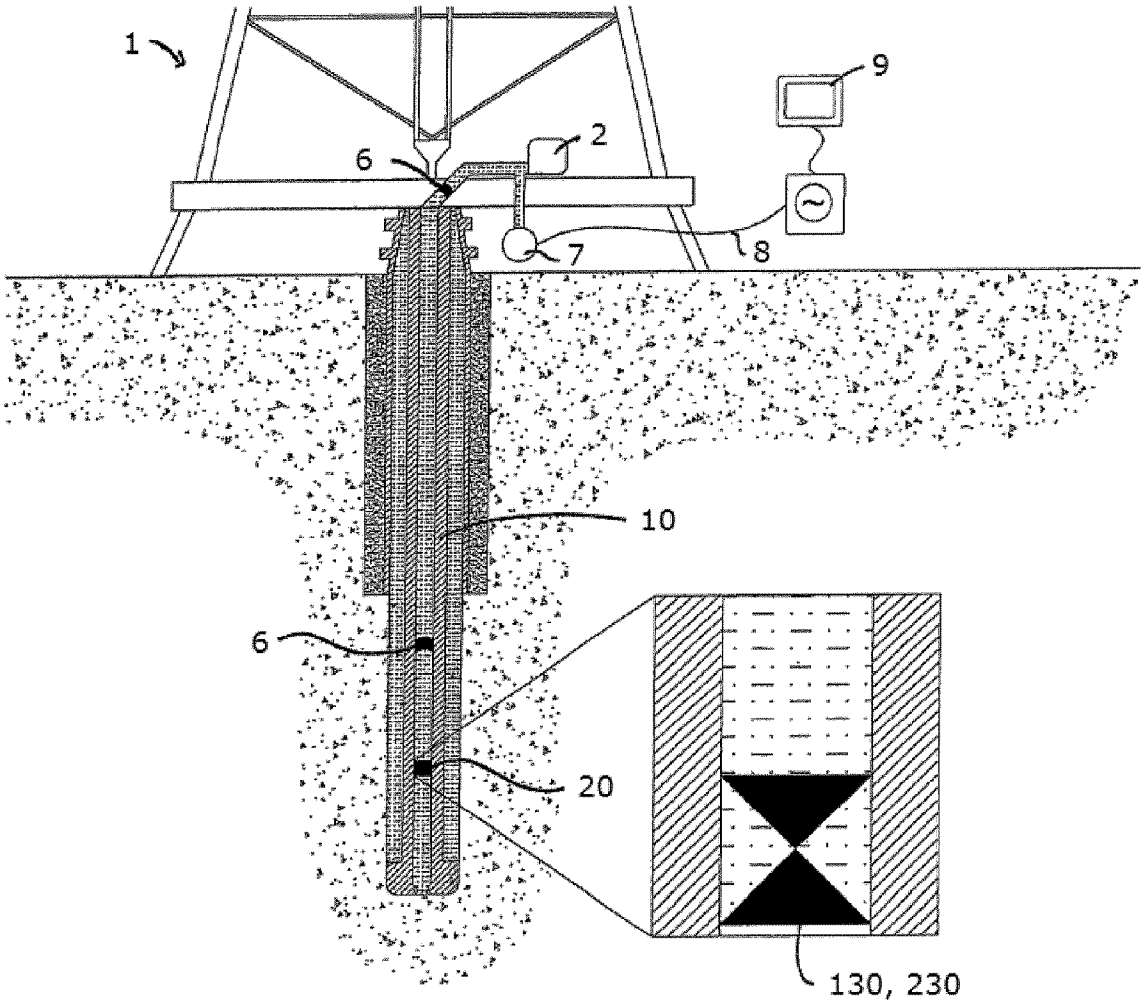
FIG. 1 is a schematic of a drill string in an oil and gas borehole comprising a MWD telemetry tool.

Referring to the drawings and specifically to FIG. 1, there is shown a schematic representation of MP telemetry operation using a fluid pressure pulse generator 130, 230 according to embodiments disclosed herein. In downhole drilling equipment 1, drilling mud is pumped down a drill string by pump 2 and passes through a measurement while drilling ("MWD") tool 20 including the fluid pressure pulse generator 130, 230. The fluid pressure pulse generator 130, 230 has an open flow position in which mud flows relatively unimpeded through the pressure pulse generator 130, 230 and no pressure pulse is generated and a restricted flow position where flow of mud through the pressure pulse generator 130, 230 is restricted and a positive pressure pulse is generated (represented schematically as block 6 in mud column 10). Information acquired by downhole sensors (not shown) is transmitted in specific time divisions by pressure pulses 6 in the mud column 10. More specifically, signals from sensor modules in the MWD tool 20, or in another downhole probe (not shown) communicative with the MWD tool 20, are received and processed in a data encoder in the MWD tool 20 where the data is digitally encoded as is well established in the art. This data is sent to a controller in the MWD tool 20 which then actuates the fluid pressure pulse generator 130, 230 to generate pressure pulses 6 which contain the encoded data. The pressure pulses 6 are transmitted to the surface and detected by a surface pressure transducer 7 and decoded by a surface computer 9 communicative with the transducer by cable 8. The decoded signal can then be displayed by the computer 9 to a drilling operator. The characteristics of the pressure pulses 6 are defined by duration, shape, and frequency; these characteristics are used in various encoding systems to represent binary data.

Figure 2A:
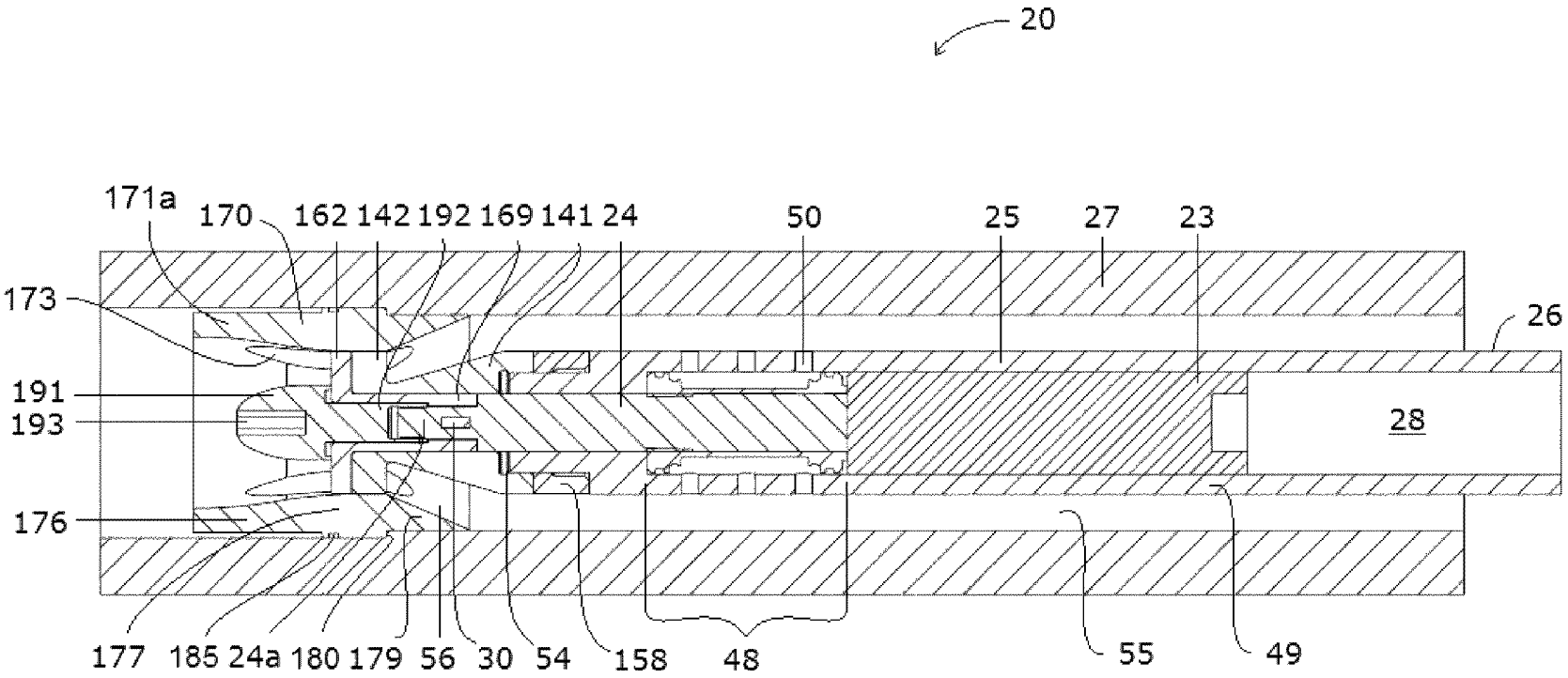
FIG. 2A is a longitudinally sectioned view of a mud pulser section of a MWD telemetry tool in a drill collar that includes a fluid pressure pulse generator according to a first embodiment and a flow bypass sleeve according to a first embodiment that surrounds the fluid pressure pulse generator inside the drill collar.
Figure 2B:
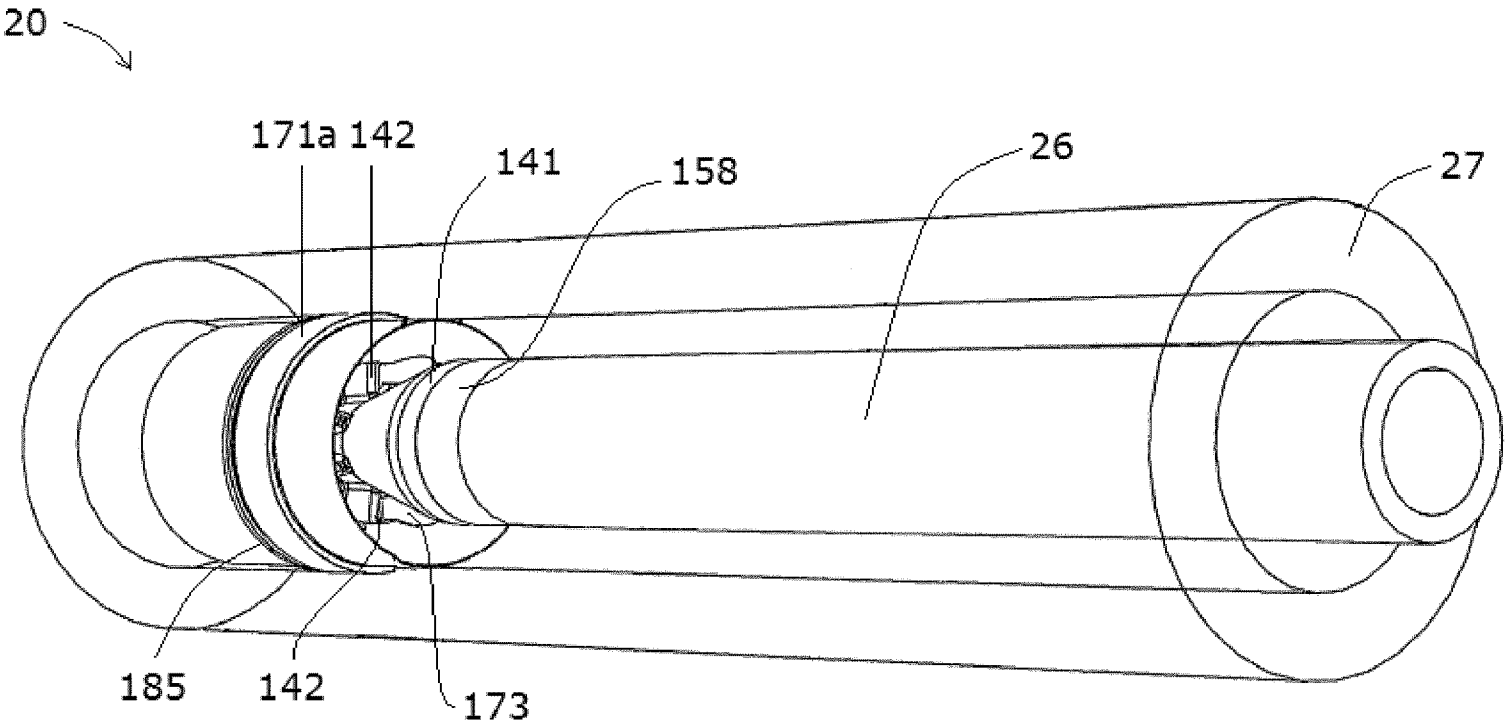
FIG. 2B is a perspective view of the mud pulser section of the MWD tool shown in FIG. 2A with the drill collar shown as transparent.

Referring to FIGS. 2A and 2B, an embodiment of the MWD tool 20 is shown in more detail. The MWD tool 20 generally comprises a fluid pressure pulse generator 130 according to a first embodiment which creates fluid pressure pulses, and a pulser assembly 26 which takes measurements while drilling and which drives the fluid pressure pulse generator 130. The fluid pressure pulse generator 130 and pulser assembly 26 are axially located inside a drill collar 27. A flow bypass sleeve 170 according to a first embodiment is received inside the drill collar 27 and surrounds the fluid pressure pulse generator 130. The pulser assembly 26 is fixed to the drill collar 27 with an annular channel 55 therebetween, and mud flows along the annular channel 55 when the MWD tool 20 is downhole. The pulser assembly 26 comprises pulser assembly housing 49 enclosing a motor subassembly 25 and an electronics subassembly 28 electronically coupled together but fluidly separated by a feed-through connector (not shown). The motor subassembly 25 includes a motor and gearbox subassembly 23, a driveshaft 24 coupled to the motor and gearbox subassembly 23, and a pressure compensation device 48. As described in more detail below with reference to FIGS. 3 and 4, the fluid pressure pulse generator 130 comprises a stator 140 and a rotor 160. The stator 140 comprises a stator body 141 fixed to the pulser assembly housing 49 and stator projections 142 radially extending around the downhole end of the stator body 141. The rotor 160 comprises rotor body 169 fixed to the driveshaft 24 and rotor projections 162 radially extending around the downhole end of the rotor body 169. Rotation of the driveshaft 24 by the motor and gearbox subassembly 23 rotates the rotor 160 relative to the fixed stator 140. The electronics subassembly 28 includes downhole sensors, control electronics, and other components required by the MWD tool 20 to determine direction and inclination information and to take measurements of drilling conditions, to encode this telemetry data using one or more known modulation techniques into a carrier wave, and to send motor control signals to the motor and gearbox subassembly 23 to rotate the driveshaft 24 and rotor 160 in a controlled pattern to generate pressure pulses 6 representing the carrier wave for transmission to surface as described above.

The motor subassembly 25 is filled with a lubricating liquid such as hydraulic oil or silicon oil and this lubricating liquid is fluidly separated from mud flowing along the annular channel 55 by an annular seal 54 which surrounds the driveshaft 24. The pressure compensation device 48 comprises a flexible membrane (not shown) in fluid communication with the lubrication liquid on one side and with mud on the other side via ports 50 in the pulser assembly housing 49; this allows the pressure compensation device 48 to maintain the pressure of the lubrication liquid at about the same pressure as the mud in the annular channel 55. Without pressure compensation, the torque required to rotate the driveshaft 24 and rotor 160 would need high current draw with excessive battery consumption resulting in increased costs. In alternative embodiments (not shown), the pressure compensation device 48 may be any pressure compensation device known in the art, such as pressure compensation devices that utilize pistons, metal membranes, or a bellows style pressure compensation mechanism.

The fluid pressure pulse generator 130 is located at the downhole end of the MWD tool 20. Mud pumped from the surface by pump 2 flows along annular channel 55 between the outer surface of the pulser assembly 26 and the inner surface of the drill collar 27. When the mud reaches the fluid pressure pulse generator 130 it flows along an annular channel 56 provided between the external surface of the stator 140 and the internal surface of the flow bypass sleeve 170. The rotor 160 can rotate between an open flow position where mud flows freely through the fluid pressure pulse generator 130 resulting in no pressure pulse and a restricted flow position where flow of mud is restricted to generate pressure pulse 6, as will be described in more detail below with reference to FIGS. 3 and 4. The flow bypass sleeve 170 includes a plurality of longitudinally extending grooves 173 and mud flows along the grooves 173 in addition to flowing through the fluid pressure pulse generator 130, as will be described in more detail below with reference to FIGS. 5 to 7.

Figure 3:
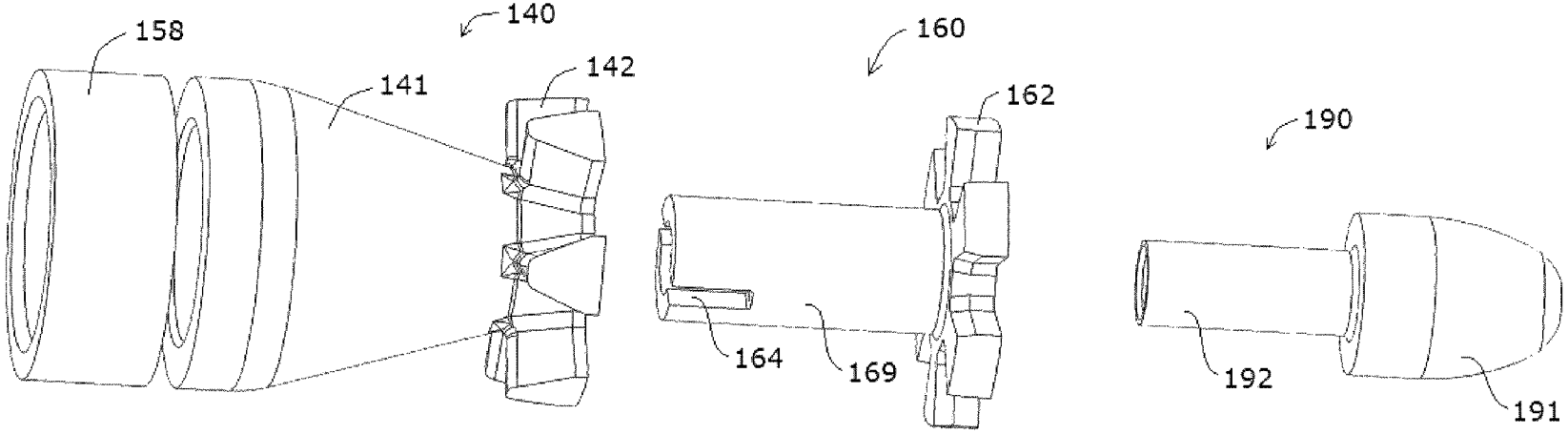
FIG. 3 is an exploded view of the fluid pressure pulse generator of the first embodiment comprising a stator and a rotor.
Figure 4A:
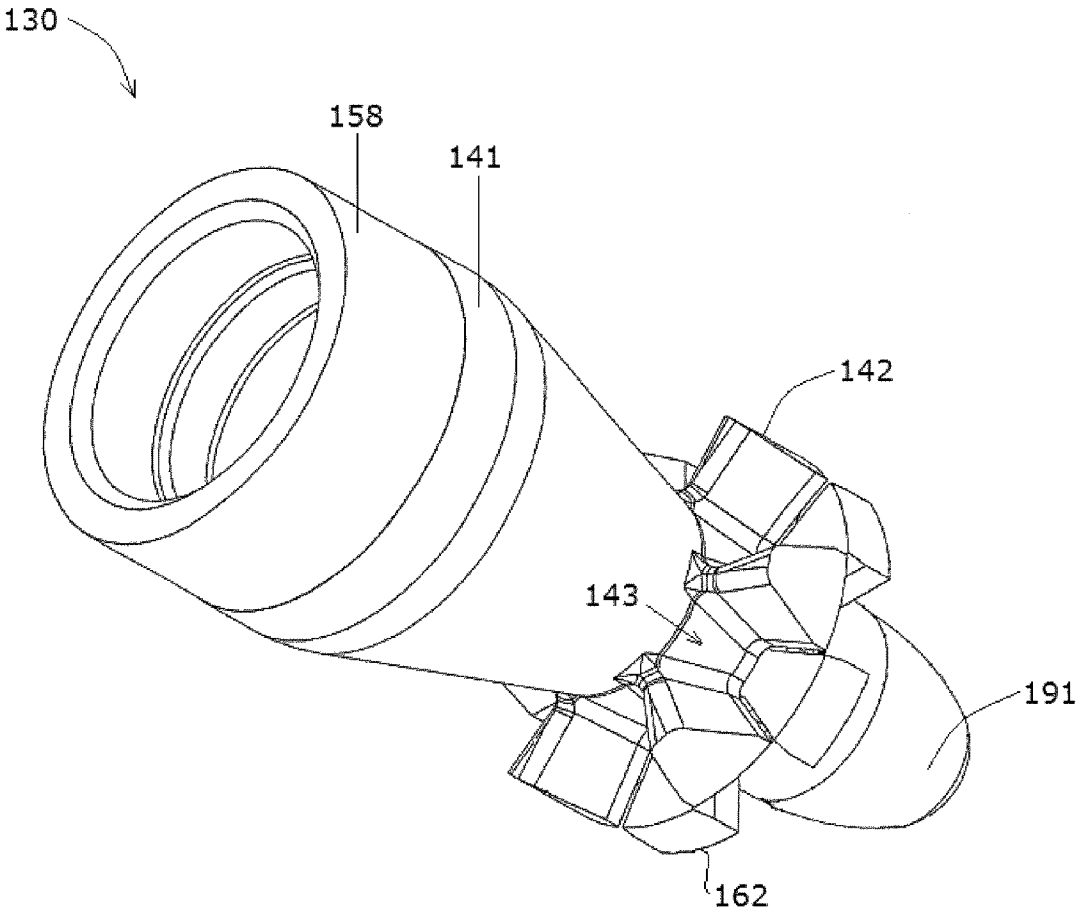
FIGS. 4A and 4B are perspective views of the fluid pressure pulse generator of the first embodiment with the rotor in a restricted flow position (FIG. 4A) and an open flow position (FIG. 4B).
Figure 4B:
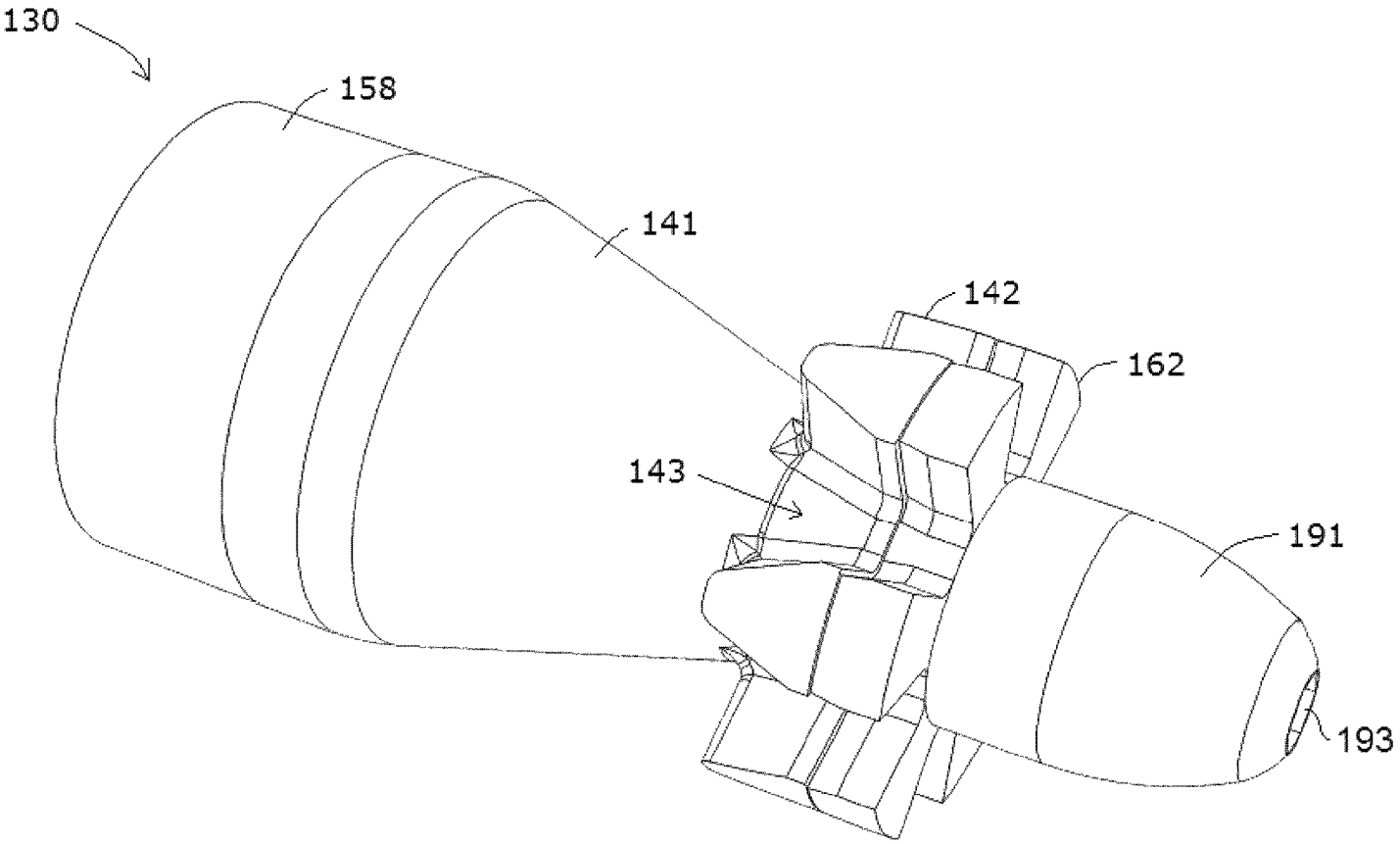

Referring to FIGS. 3 and 4, the first embodiment of the fluid pressure pulse generator 130 comprising stator 140 and rotor 160 is shown in more detail. The stator 140 comprises longitudinally extending stator body 141 with a central bore therethrough. The stator body 141 comprises a cylindrical section at the uphole end and a generally frusto-conical section at the downhole end which tapers longitudinally in the downhole direction. As shown in FIGS. 2A and 2B, the cylindrical section of stator body 141 is coupled with the pulser assembly housing 49. More specifically, a jam ring 158 threaded on the stator body 141 is threaded onto the pulser assembly housing 49. Once the stator 140 is positioned correctly, the stator 140 is held in place and the jam ring 158 is backed off and torqued onto the stator 140 holding it in place. The external surface of the pulser assembly housing 49 is flush with the external surface of the cylindrical section of the stator body 141 for smooth flow of mud therealong. A plurality of radially extending projections 142 are spaced equidistant around the downhole end of the stator body 141.

The rotor 160 comprises generally cylindrical rotor body 169 with a central bore therethrough and a plurality of radially extending projections 162. As shown in FIG. 2A, the rotor body 169 is received in the downhole end of the bore in the stator body 141. A downhole shaft 24*a* of the driveshaft 24 is received in uphole end of the bore in the rotor body 169 and a coupling key 30 extends through the driveshaft 24 and is received in a coupling key receptacle 164 at the uphole end of the rotor body 169 to couple the driveshaft 24 with the rotor body 169. A rotor cap 190 comprising a cap body 191 and a cap shaft 192 is positioned at the downhole end of the fluid pressure pulse generator 130. The cap shaft 192 is received in the downhole end of the bore in the rotor body 169 and threads onto the downhole shaft 24*a* of the driveshaft 24 to lock (torque) the rotor 160 to the driveshaft 24. The cap body 191 includes a hexagonal shaped opening 193 dimensioned to receive a hexagonal Allen key which is used to torque the rotor 160 to the driveshaft 24. The rotor cap 190 therefore releasably couples the rotor 160 to the driveshaft 24 so that the rotor 160 can be easily removed and repaired or replaced if necessary using the Allen key.

The radially extending rotor projections 162 are equidistantly spaced around the downhole end of the rotor body 169 and are axially adjacent and downhole relative to the stator projections 142 in the assembled fluid pressure pulse generator 130. In use, mud flowing along the external surface of the stator body 141 contacts the stator projections 142 and flows through stator flow channels 143 defined by adjacently positioned stator projections 142. The rotor projections 162 align with the stator projections 142 when the rotor 160 is in the open flow position shown in FIG. 4B and mud flows freely through the stator flow channels 143 resulting in no pressure pulse. The rotor 160 rotates to the restricted flow position shown in FIG. 4A where the rotor projections 162 align with the stator flow channels 143 and the volume of mud flowing through the stator flow channels 143 is restricted (reduced) resulting in pressure pulse 6. The rotor projections 162 rotate in and out of fluid communication with the stator flow channels 143 in a controlled pattern to generate pressure pulses 6 representing the carrier wave for transmission to surface. In alternative embodiments (not shown), the rotor projections 162 may be positioned uphole relative to the stator projections 142.

In alternative embodiments (not shown) the fluid pressure pulse generator may be any rotor/stator type fluid pressure pulse generator where the stator includes flow channels or orifices through which mud flows and the rotor rotates relative to the fixed stator to move in and out of fluid communication with the flow channels or orifices to generate pressure pulses 6. The fluid pressure pulse generator may be positioned at either the downhole or uphole end of the MWD tool 20.

Figure 5:
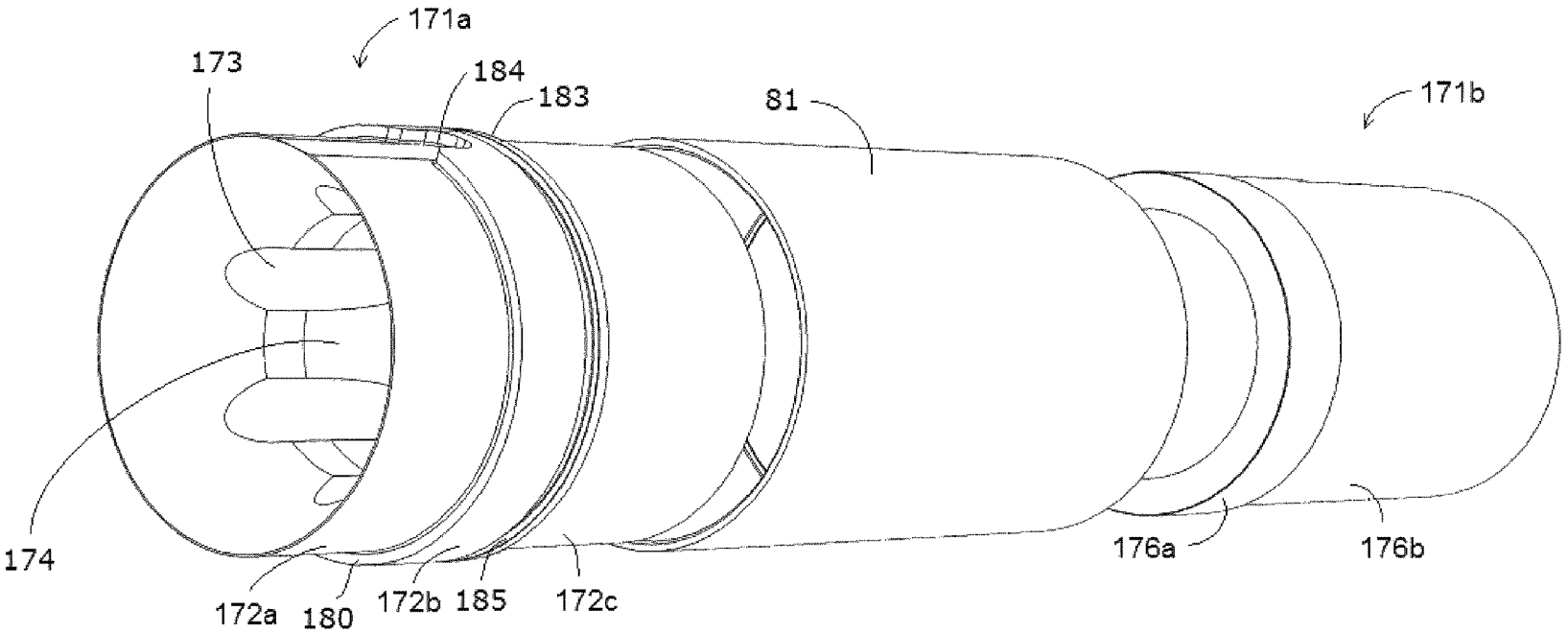
FIG. 5 is an exploded view of the flow bypass sleeve of the first embodiment.
Figure 6A:
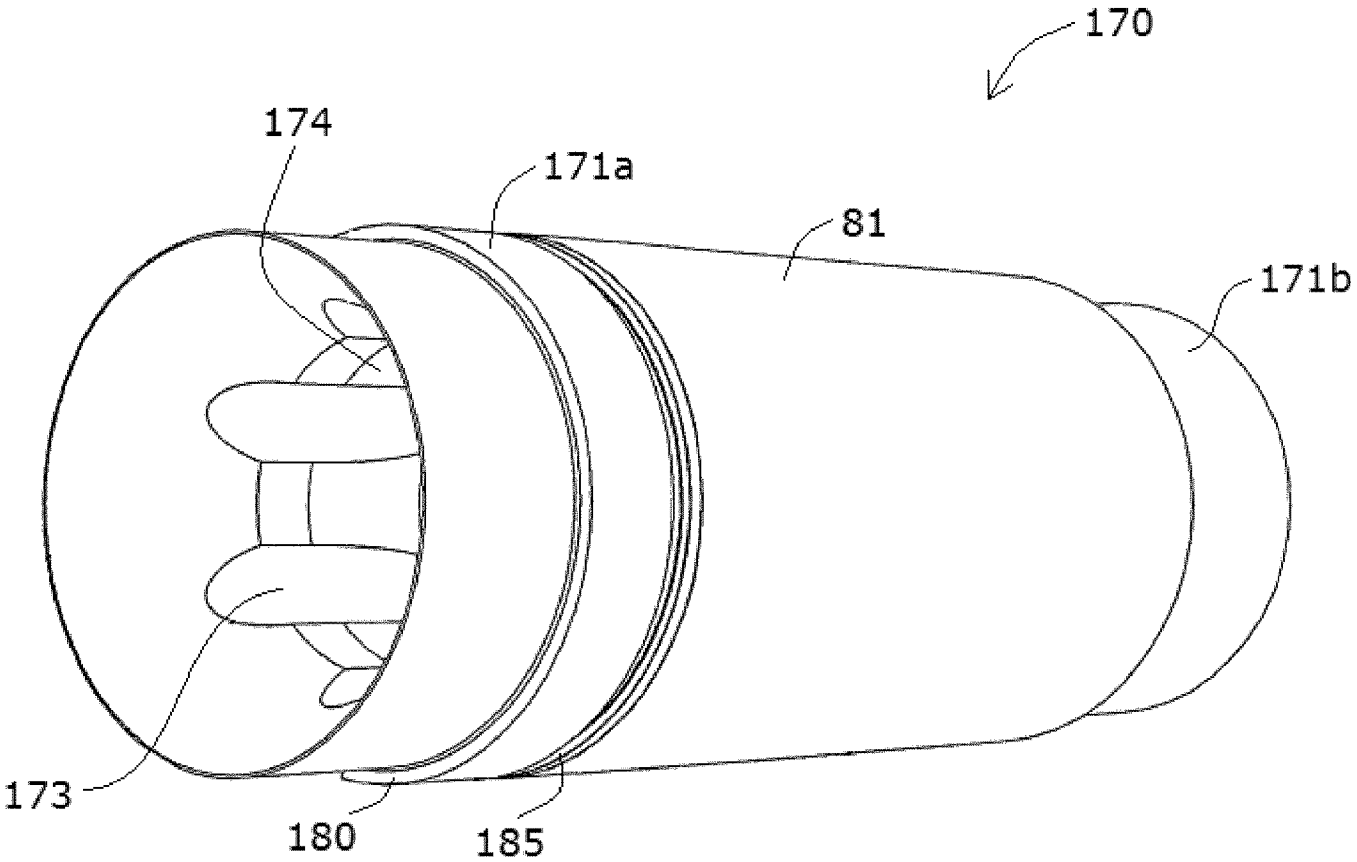
FIG. 6A is a perspective view of the flow bypass sleeve of the first embodiment.
Figure 6B:
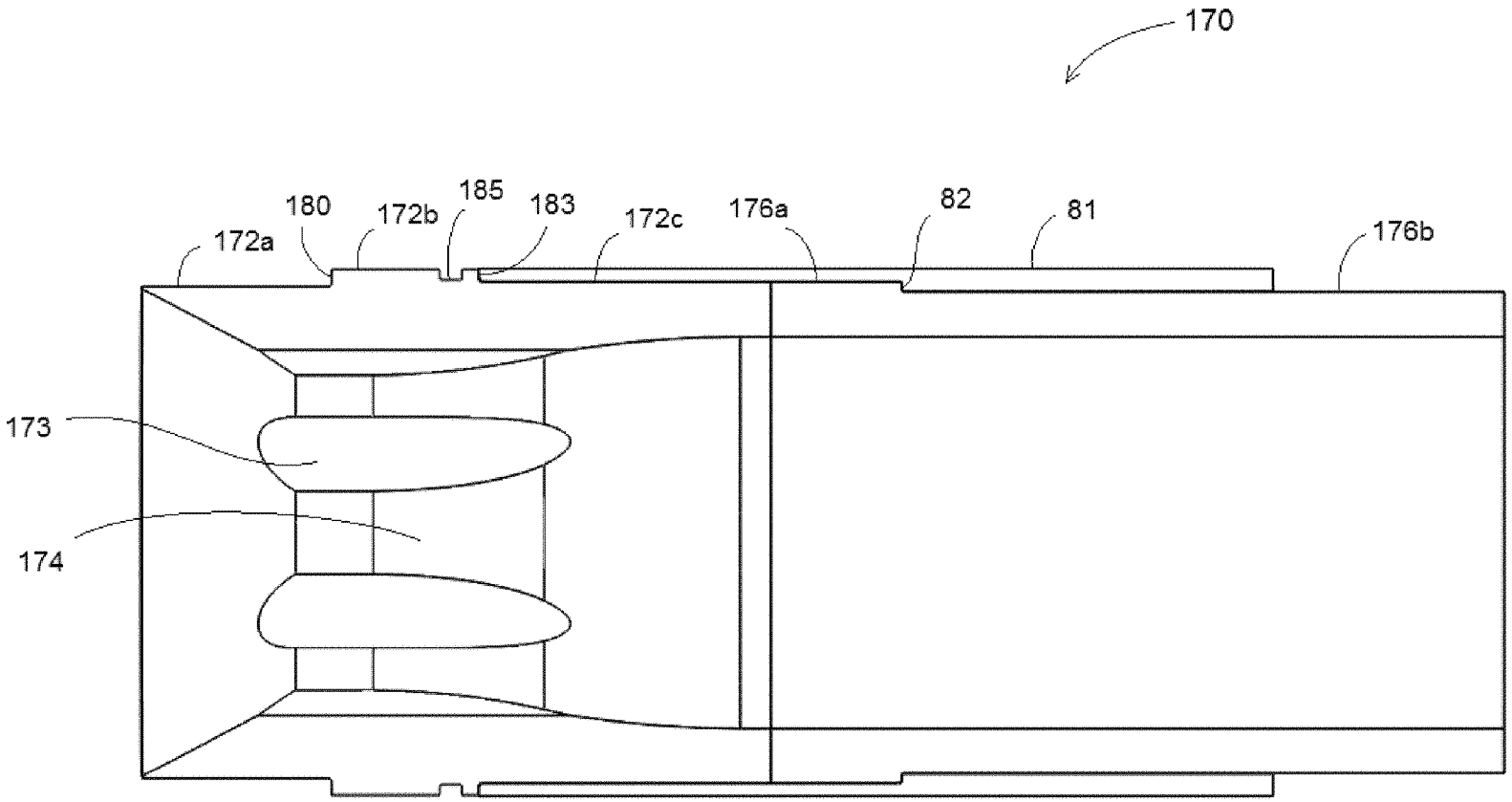
FIG. 6B is a longitudinally sectioned view of the flow bypass sleeve of the first embodiment.
Figure 7:
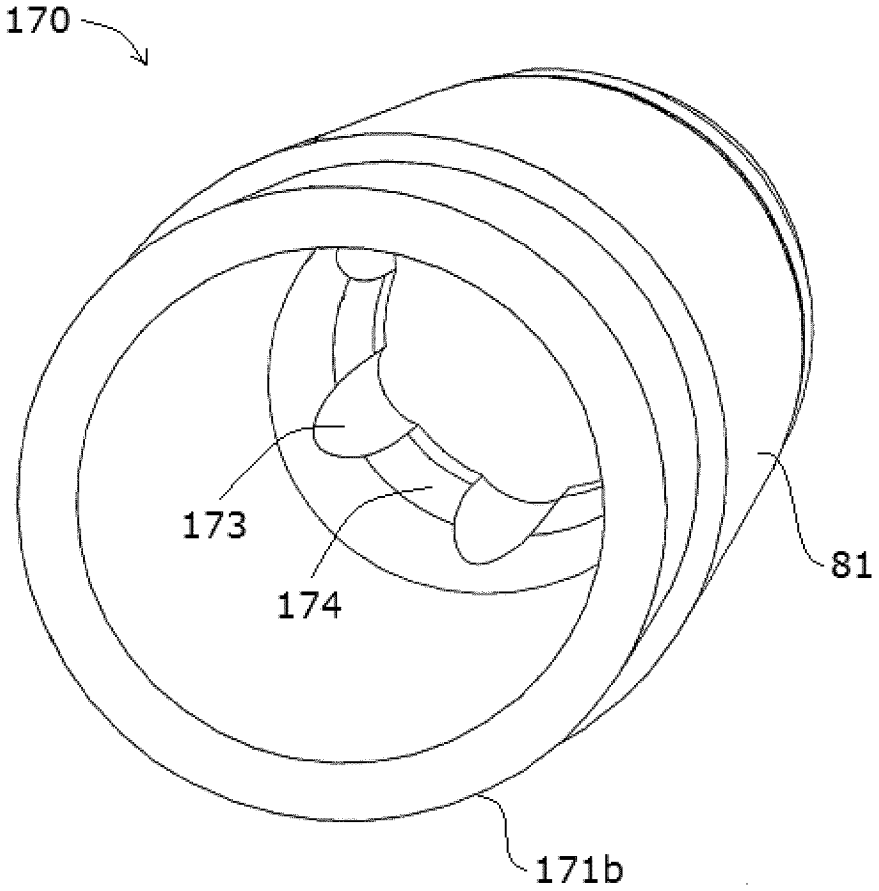
FIG. 7 is a perspective view of the downhole end of the flow bypass sleeve of the first embodiment.

Referring now to FIGS. 5 to 7 the flow bypass sleeve 170 of the first embodiment is shown in more detail and comprises a generally cylindrical sleeve body with a central bore therethrough and a lock down sleeve 81 surrounding the sleeve body. The sleeve body comprises an uphole body section 171*a* and an axially aligned downhole body section 171*b*. The external surface of the uphole body section 171*a* has an uphole portion 172*a*, a downhole portion 172*c* and a central portion 172*b* positioned between the uphole and downhole body portions 172*a*, 172*c*. As shown in FIG. 6B the external circumference of the central portion 172*b* is greater than the external circumference of the uphole and downhole portions 172*a*, 172*c*. The external surface of the downhole body section 171*b* has an uphole portion 176*a* and a downhole portion 176*b* and the external circumference of the uphole portion 176*a* is greater than the external circumference of the downhole portion 176*b*. The uphole portion 176*a* of the downhole body section 171*b* has the same external circumference as the external circumference of the downhole portion 172*c* of the uphole body section 171*a*.

During assembly of the flow bypass sleeve 170, the uphole body section 171*a* and downhole body section 171*b* are positioned axially adjacent each other and the lock down sleeve 81 is received on the downhole end of the downhole body section 171*b* and moved towards the uphole body section 171*a* until the uphole end of the lock down sleeve 81 abuts an annular shoulder 183 provided by the downhole edge of the central portion 172*b* of the uphole body section 171*a*. The lock down sleeve 81 includes an annular shoulder 82 on an internal surface of the sleeve which abuts the downhole edge of the uphole portion 176*a* of the downhole body section 171*b*. The lock down sleeve 81 surrounds the downhole portion 172*c* of the uphole body section 171*a* as well as the uphole portion 176*a* and part of the downhole portion 176*b* of the downhole body section 171*b*. The assembled flow bypass sleeve 170 can then be inserted into the downhole end of drill collar 27. An annular shoulder 180 provided by the uphole edge of the central portion 172*b* of the uphole body section 171*a* abuts a downhole shoulder of a keying or mounting ring that is press fitted into the drill collar 27 as shown in FIG. 2A. A keying notch 184 on the external surface of uphole body section 171*a* mates with a projection (not shown) on the keying ring to align the flow bypass sleeve 170 with the pulser assembly 26. A threaded ring (not shown) threaded into the downhole end of the drill collar 27 locks the lock down sleeve 81 in position on the sleeve body with annular shoulder 82 in contact with the downhole edge of the uphole portion 176*a* of the downhole body section 171*b* so that the uphole and downhole body sections 171*a*, 171*b* maintain contact with each other. A groove 185 on the external surface of the central portion 172*b* of uphole body section 171*a* receives an o-ring (not shown) and a rubber back-up ring (not shown) such as a parbak which may help seat the flow bypass sleeve 170 and reduce fluid leakage between the flow bypass sleeve 170 and the drill collar 27. In alternative embodiments the flow bypass sleeve 170 may be mounted or fitted within the drill collar 27 using an alternative mechanism as would be known to a person of skill in the art. In alternative embodiments, the flow bypass sleeve 170 may comprise just the uphole body section 171*a* and the downhole body section 171*b* and/or lock down sleeve 81 may not be present.

Figure 8:
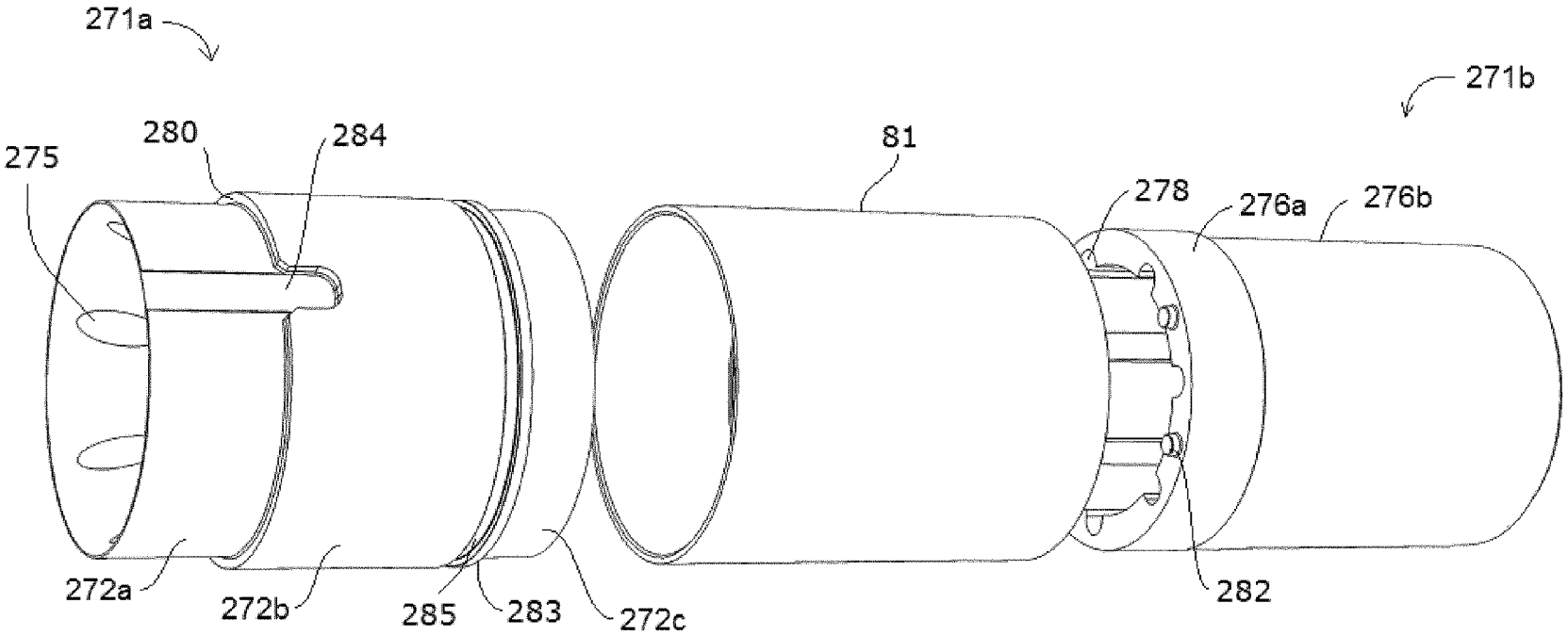
FIG. 8 is an exploded view of a flow bypass sleeve according to a second embodiment.
Figure 9A:
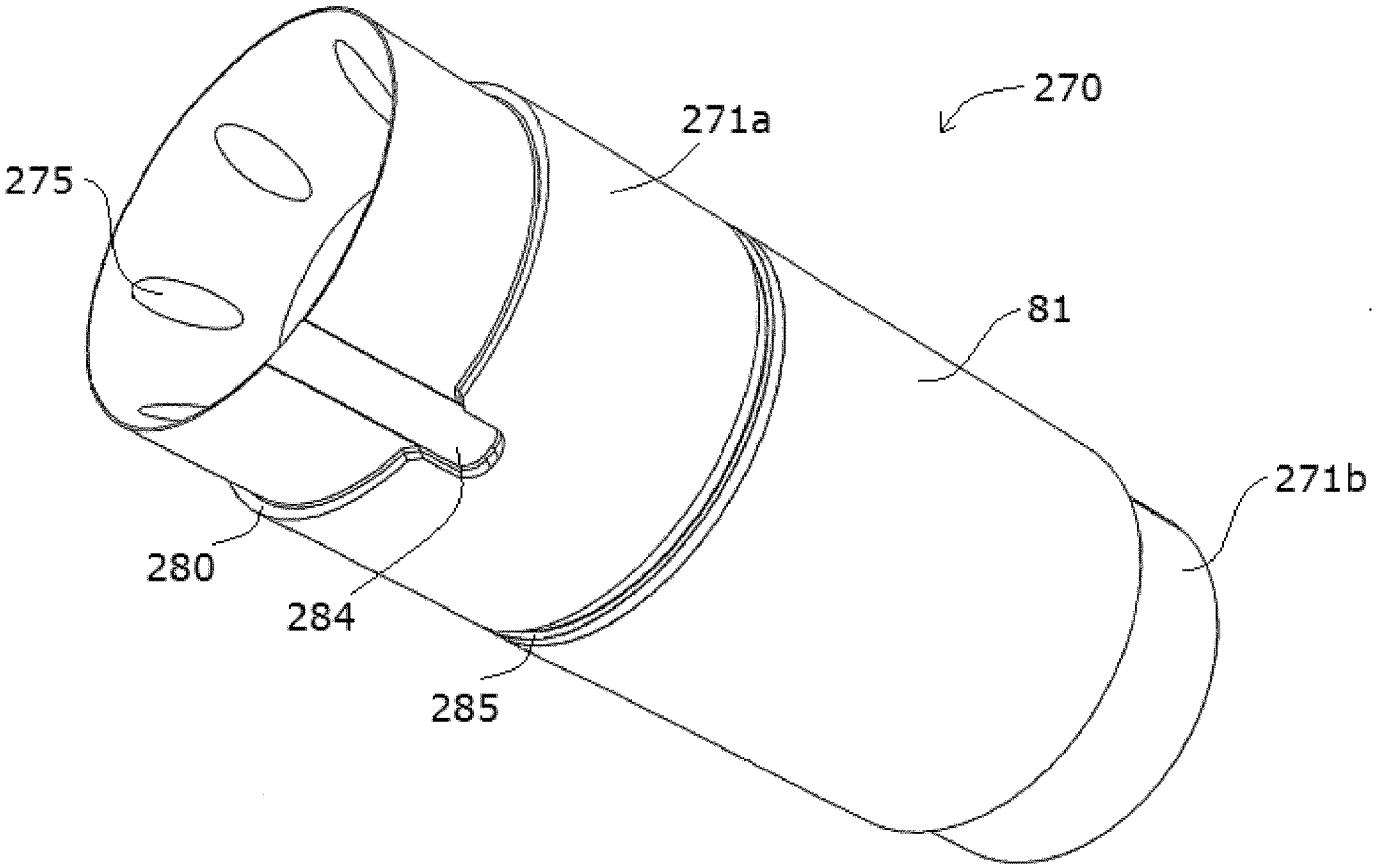
FIG. 9A is a perspective view of the flow bypass sleeve of the second embodiment.
Figure 9B:
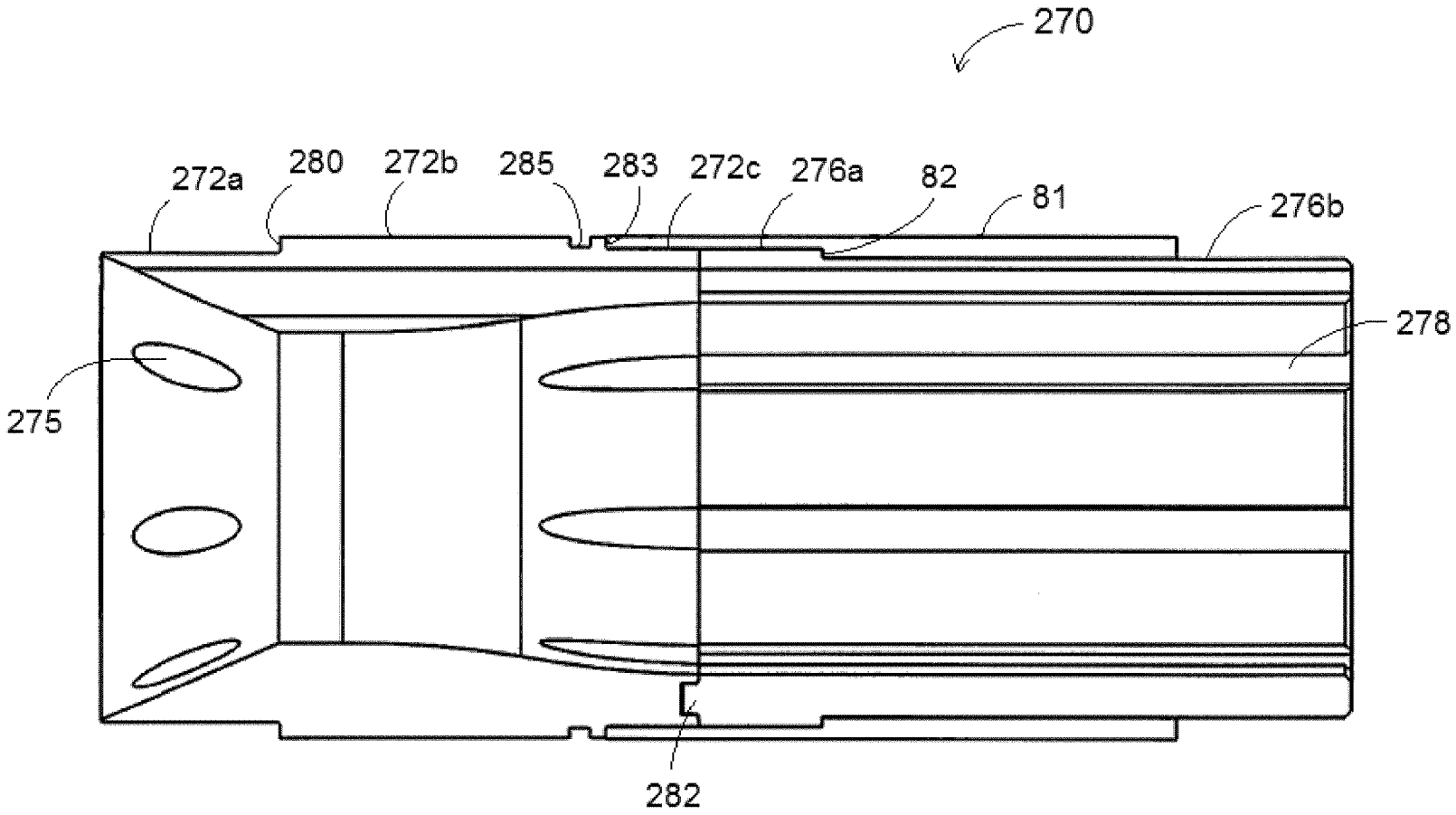
FIG. 9B is a longitudinally sectioned view of the flow bypass sleeve of the second embodiment.
Figure 10:
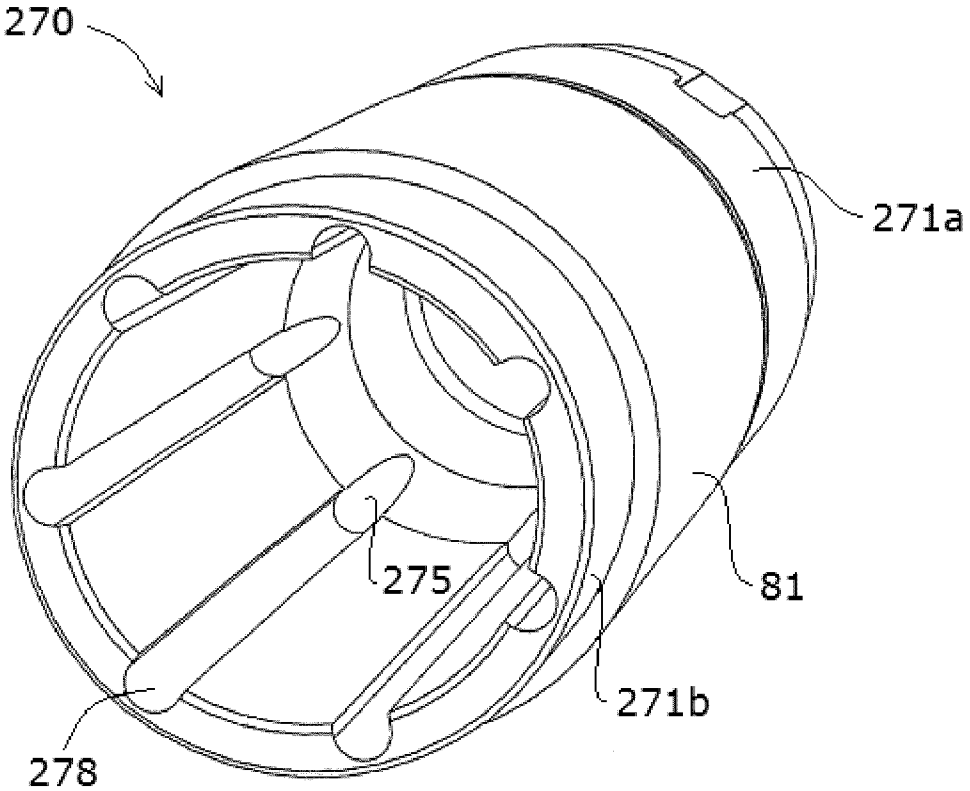
FIG. 10 is a perspective view of the downhole end of the flow bypass sleeve of the second embodiment.

Referring to FIGS. 8 to 10 a second embodiment of a flow bypass sleeve 270 is shown comprising a generally cylindrical sleeve body with a central bore therethrough and a lock down sleeve 81 surrounding the sleeve body. The sleeve body comprises an uphole body section 271*a* and an axially aligned downhole body section 271*b*. The external surface of the uphole body section 271*a* has an uphole portion 272*a*, a downhole portion 272*c* and a central portion 272*b* positioned between the uphole and downhole body portions 272*a*, 272*c*. As shown in FIG. 9B the external circumference of the central portion 272*b* is greater than the external circumference of the uphole and downhole portions 272*a*, 272*c*. The external surface of the downhole body section 271*b* has an uphole portion 276*a* and a downhole portion 276*b* and the external circumference of the uphole portion 276*a* is greater than the external circumference of the downhole portion 276*b*. The uphole portion 276*a* of the downhole body section 271*b* has the same external circumference as the external circumference of the downhole portion 272*c* of the uphole body section 271*a*.

During assembly of the flow bypass sleeve 270, the uphole body section 271*a* and downhole body section 271*b* are positioned axially adjacent each other and alignment pins 282 on the uphole edge of the downhole body section 271*b* are received in recesses on the downhole edge of the uphole body section 271*a*. The lock down sleeve 81 is received on the downhole end of the downhole body section 271*b* and moved towards the uphole body section 271*a* until the uphole end of the lock down sleeve 81 abuts an annular shoulder 283 provided by the downhole edge of the central portion 272*b* of the uphole body section 271*a*. The lock down sleeve 81 includes an annular shoulder 82 on an internal surface of the sleeve which abuts the downhole edge of the uphole portion 276*a* of the downhole body section 271*b*. The lock down sleeve 81 surrounds the downhole portion 272*c* of the uphole body section 271*a* as well as the uphole portion 276*a* and part of the downhole portion 276*b* of the downhole body section 271*b*. The assembled flow bypass sleeve 270 can then be inserted into the downhole end of drill collar 27. An annular shoulder 280 provided by the uphole edge of the central portion 272*b* of the uphole body section 271*a* abuts a downhole shoulder of a keying or mounting ring that is press fitted into the drill collar 27. A keying notch 284 on the external surface of uphole body section 271*a* mates with a projection on the keying ring to align the flow bypass sleeve 270 with the pulser assembly 26. A threaded ring threaded into the downhole end of the drill collar 27 locks the lock down sleeve 81 in position on the sleeve body with annular shoulder 82 in contact with the downhole edge of the uphole portion 276*a* of the downhole body section 271*b* so that the uphole and downhole body sections 271*a*, 271*b* maintain contact with each other. A groove 285 on the external surface of the central portion 272*b* of uphole body section 271*a* receives an o-ring (not shown) and a rubber back-up ring (not shown) such as a parbak which may help seat the flow bypass sleeve 270 and reduce fluid leakage between the flow bypass sleeve 270 and the drill collar 27. In alternative embodiments the flow bypass sleeve 270 may be mounted or fitted within the drill collar 27 using an alternative mechanism as would be known to a person of skill in the art. In alternative embodiments, the flow bypass sleeve 270 may comprise just the uphole body section 271*a* and the downhole body section 271*b* and/or lock down sleeve 81 may not be present.

The lock down sleeve 81 may be made from the same material or a different material to the uphole body section 171*a*, 271*a*. The material of the lock down sleeve 81 may have a different thermal expansion coefficient than the material of the uphole body section 171*a*, 271*a*. For example, the lock down sleeve 81 may comprise beryllium copper and the uphole body section 171*a*, 271*a* may comprise Stellite. This different thermal expansion coefficient of the different materials that make up the external surface of flow bypass sleeve 170, 270 may result in the flow bypass sleeve 170, 270 being securely clamped within the drill collar 27 across a wider range of temperatures than if the flow bypass sleeve 170, 270 was made of the same material throughout. The lock down sleeve 81 may be protected from erosion caused by mud flow by the upstream keying ring and o-ring received in groove 185, 285 of the uphole body section 171*a*, 271*a*. The material of the lock down sleeve 81 may therefore be chosen for its thermal expansion properties rather than having to be chosen for its ability to resist erosion caused by mud. The lock down sleeve 81 may allow the flow bypass sleeve 170, 270 to be reliably secured within the drill collar 27 over a wide range of temperatures than a flow bypass sleeve without the lock down sleeve and its performance may not affected by mud flow over time.

FIG. 2A shows the uphole body section 171*a* of the flow bypass sleeve 170 of the first embodiment received in the drill collar 27 and surrounding the fluid pressure pulse generator 130 of the first embodiment. The diameter of the bore through the uphole body section 171*a* is smallest at a central section 177 which surrounds the stator projections 142 and rotor projections 162. The stator projections 142 may be dimensioned such that the stator projections 142 contact the internal surface of the central section 177. The outer diameter of the rotor projections 162 is slightly less than the internal diameter of the central section 177 to allow rotation of the rotor projections 162 relative to the uphole body section 171*a*. The bore through the uphole body section 171*a* gradually increases in diameter from the central section 177 towards the downhole end of the uphole body section 171*a* to define an internally tapered downhole section 176. The bore through the sleeve body also increases in diameter from the central section 177 towards the uphole end of the uphole body section 171*a* to define an internally tapered uphole section 179. The taper of the uphole section 179 is greater than the taper of downhole section 176. The uphole section 179 surrounds the frusto-conical section of stator body 141 with annular channel 56 extending therebetween. Mud flows along annular channel 56 and hits the stator projections 142 where it is channeled into the stator flow channels 143. The downhole section 176 surrounds the rotor cap body 191. The internal surface of the central section 177 includes longitudinally extending grooves 173 with an inlet in the uphole section 179 and an outlet in the downhole section 176. Mud flows from annular channel 56 through the longitudinally extending grooves 173 into the bore in the downhole section 176 in addition to flowing through stator flow channels 143 of the fluid pressure pulse generator 130. The uphole body section 271*a* of the flow bypass sleeve 270 of the second embodiment has similar internal dimensions as the uphole body section 171*a* of the flow bypass sleeve 170 of the first embodiment as shown in FIG. 9B.

Figure 11:
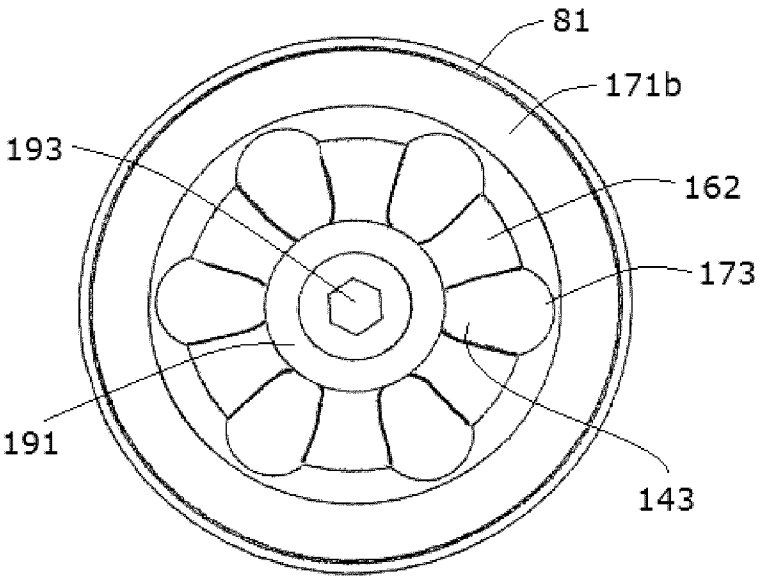
FIG. 11 is a downhole end view of the flow bypass sleeve of the first embodiment surrounding the fluid pressure pulse generator of the first embodiment with the rotor in the open flow position.

In the first embodiment of the flow bypass sleeve 170, bypass flow channels are provided by the longitudinal extending grooves 173 which are equidistantly spaced around the internal surface of the uphole body section 171*a*. Internal walls 174 in-between each groove 173 align with the stator projections 142 of the fluid pressure pulse generator 130, and the grooves 173 align with the stator flow channels 143. The flow bypass sleeve 170 is precisely located with respect to the drill collar 27 using keying notch 184 to ensure correct alignment of the stator projections 142 with the internal walls 174. In alternative embodiments an alternative alignment mechanism may be used which provides alignment of the flow bypass sleeve 170 within the drill collar 27 such that the stator projections 142 align with the internal walls 174. The rotor projections 162 rotate relative to the flow bypass sleeve 170 and move between the open flow position (shown in FIG. 11) where the rotor projections 162 align with the internal walls 174 and the restricted flow position (not shown) where the rotor projections 162 align with the grooves 173. The grooves 173 are semi-circular shaped, however in alternative embodiments (not shown) the grooves may be any shape and dimensioned for the desired amount of mud flow therethrough.

Figure 12:
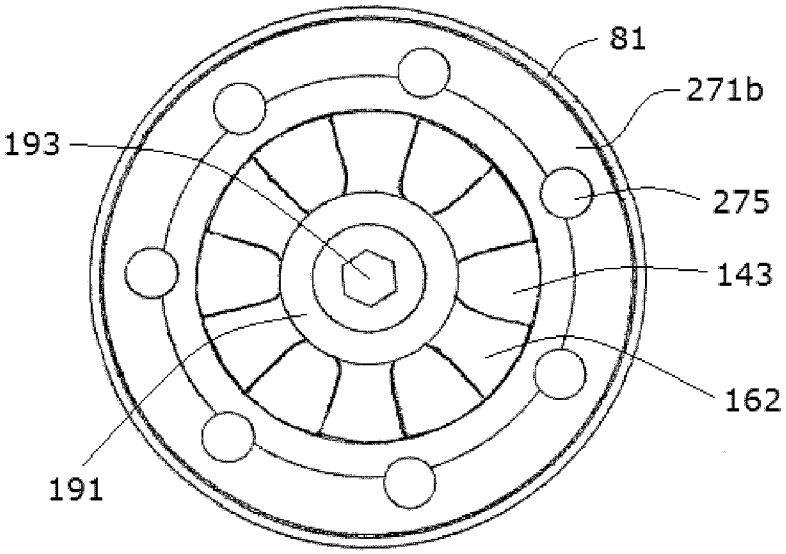
FIG. 12 is a downhole end view of the flow bypass sleeve of the second embodiment surrounding the fluid pressure pulse generator of the first embodiment with the rotor in the open flow position.

In the second embodiment of the flow bypass sleeve 270 the bypass flow channels are provided by a plurality of apertures 275 extending longitudinally through the uphole body section 271*a*. The apertures 275 are circular and equidistantly spaced around uphole body section 271*a*. The internal surface of the downhole body section 271*b* includes a plurality of spaced grooves 278 which align with the apertures 275 such that mud is channeled through the apertures 275 and into grooves 278. The alignment pins 282 on the uphole edge of the downhole body section 271*b* are received in recesses 289 (shown in FIG. 14) on the downhole edge of the uphole body section 271*a* to correctly align the apertures 275 with the grooves 278. The internal surface of uphole body section 271*a* which surrounds the rotor and stator projections 162, 142 is uniform in this embodiment (as shown in FIG. 12); therefore there is no need to align the stator projections 142 with any internal feature of the uphole body section 271*a* as with the first embodiment of the flow bypass sleeve 170 described above. The keying notch 284 or other alignment mechanism may therefore not be present and the flow bypass sleeve 270 may be inserted into a mounting ring or other mounting mechanism (without an alignment mechanism) to mount the flow bypass sleeve 270 within the drill collar 27. Other mechanisms for fitting or mounting the flow bypass sleeve 270 within the drill collar 27 as would be known to a person of skill in the art may alternatively be used.

The uphole body section 271*a* generally needs to be thick enough to support the apertures 275 and the drill collar dimensions may be a limiting factor with respect to use of the second embodiment of the flow bypass sleeve 270. As such, the second embodiment of the flow bypass sleeve 270 may be used with larger drill collars 27, for example drill collars that are 8 inches or more in diameter. In alternative embodiments (not shown) the apertures 275 may be any shape and need not be equidistantly spaced around the sleeve body. The number and size of the apertures 275 may be chosen for the desired amount of mud flow therethrough. In further alternative embodiments (not shown) the grooves 278 may have a different shape or may not be present at all.

In an alternative embodiment (not shown), the sleeve body may include bypass channels comprising both internal grooves 173 and longitudinally extending apertures 275 for flow of mud therethrough.

Figure 15A:
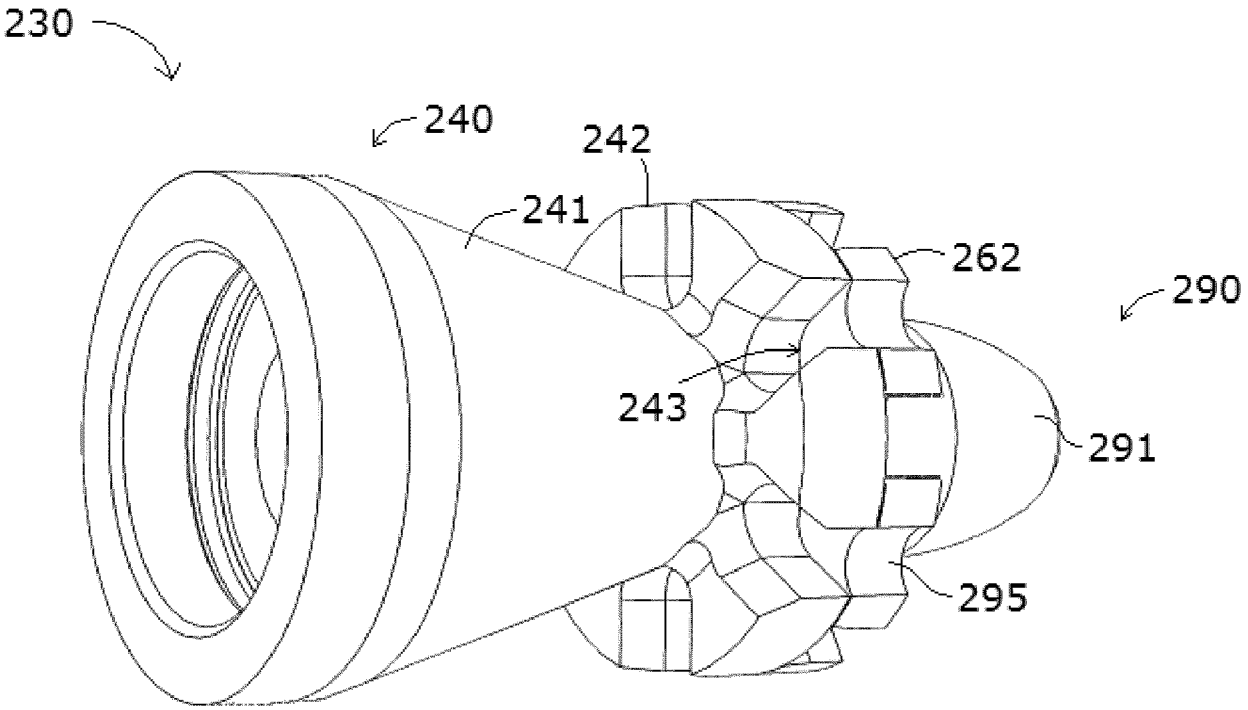
FIGS. 15A and 15B are perspective views of a fluid pressure pulse generator according to a second embodiment comprising a rotor and a stator, with the rotor in a restricted flow position (FIG. 15A) and in an open flow position (FIG. 15B).
Figure 15B:
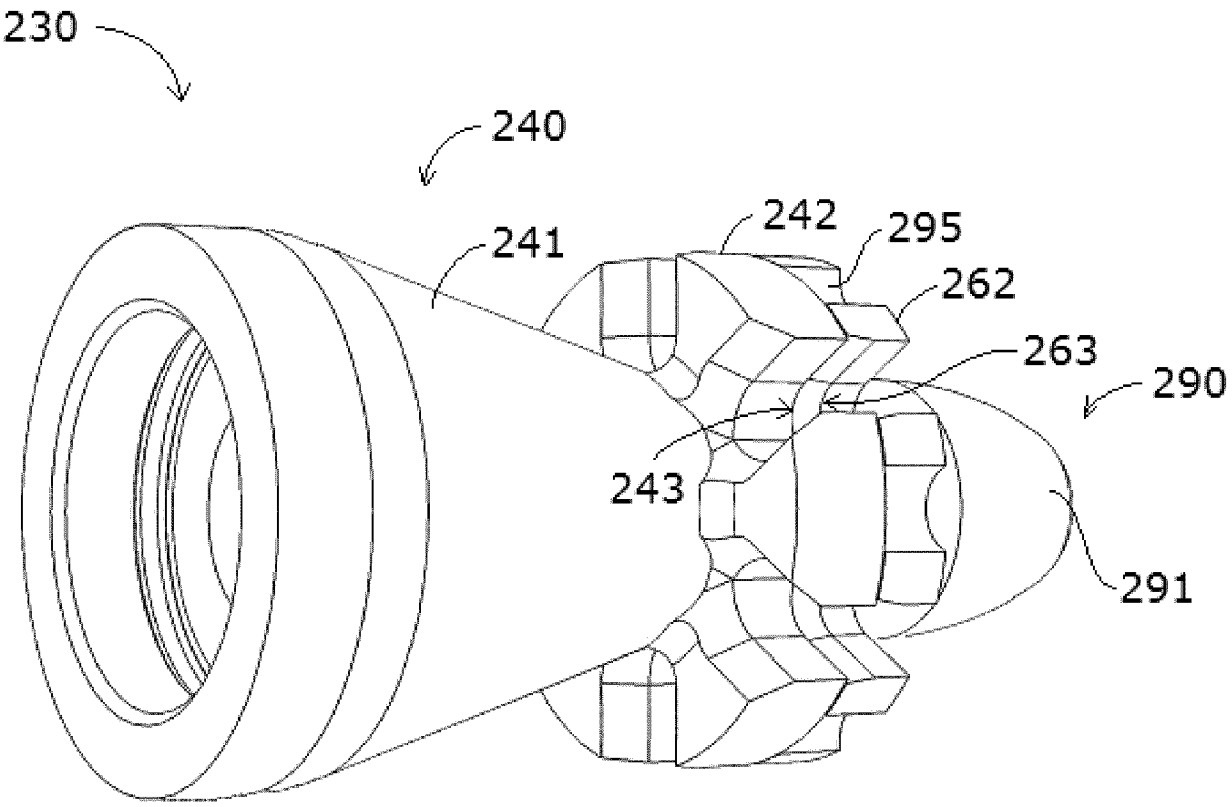
Figure 16:
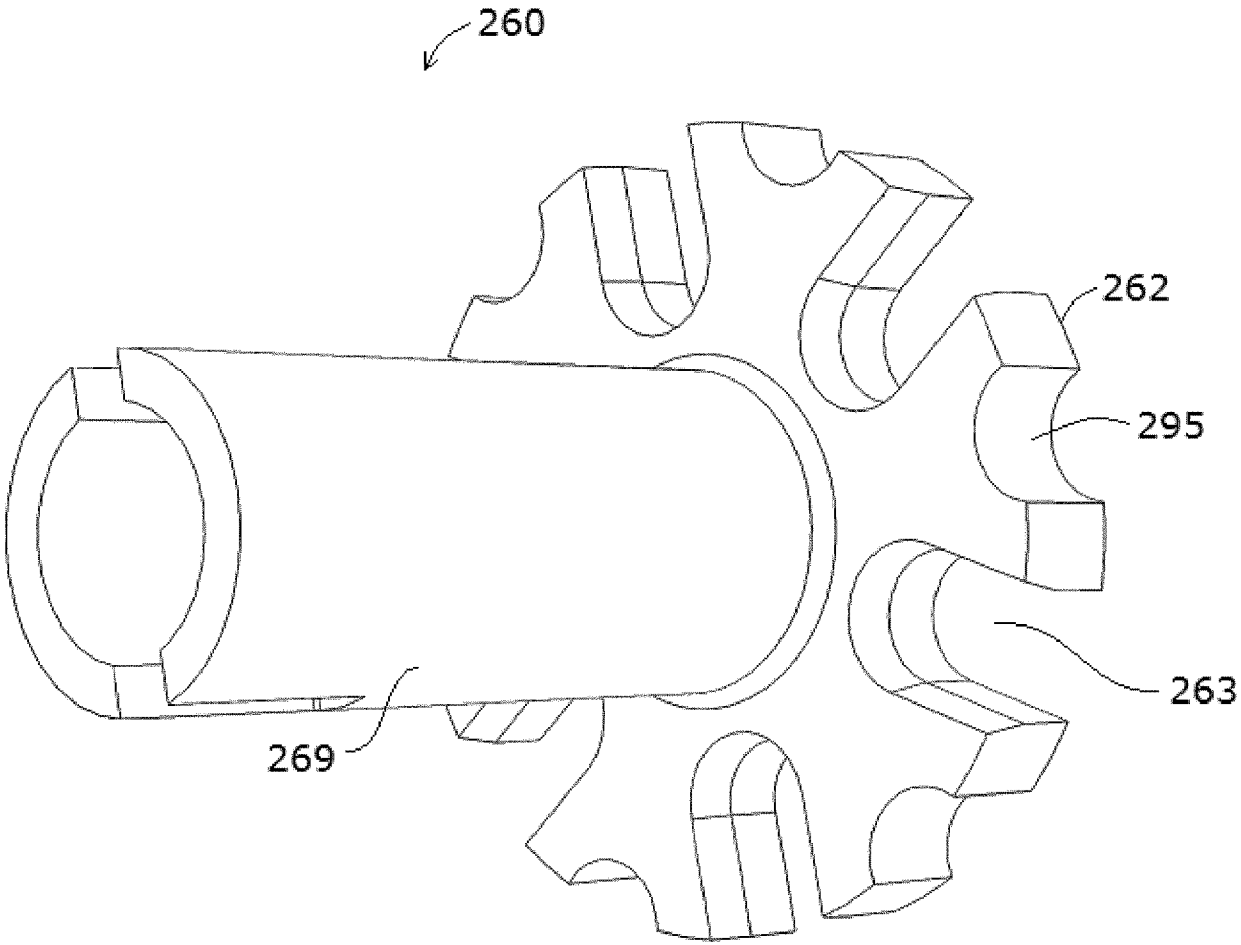
FIG. 16 is a perspective view of the rotor of the fluid pressure pulse generator of the second embodiment.
Figure 17:
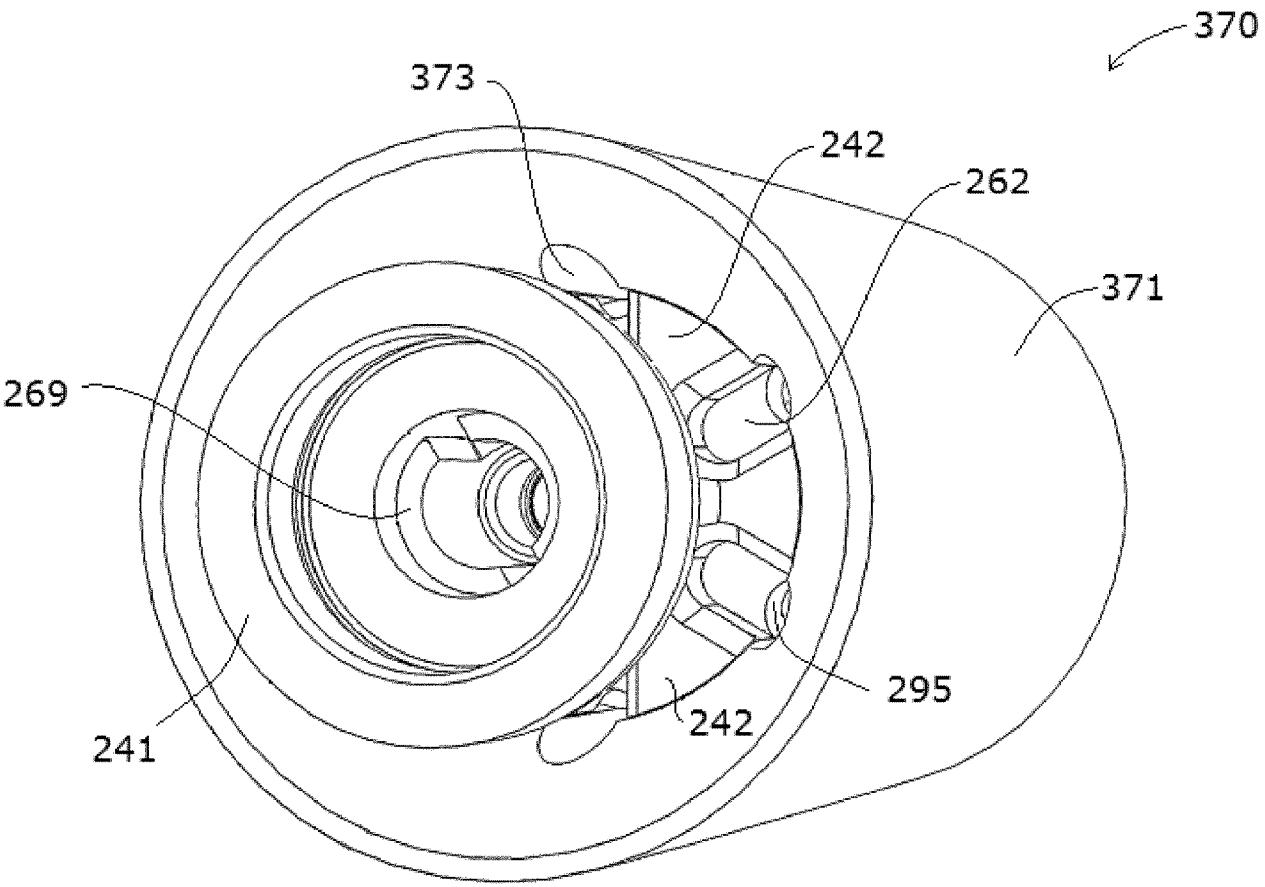
FIG. 17 is a perspective view of the uphole end of a flow bypass sleeve according to a third embodiment surrounding the fluid pressure pulse generator of the second embodiment with the rotor in the restricted flow position.
Figure 18:
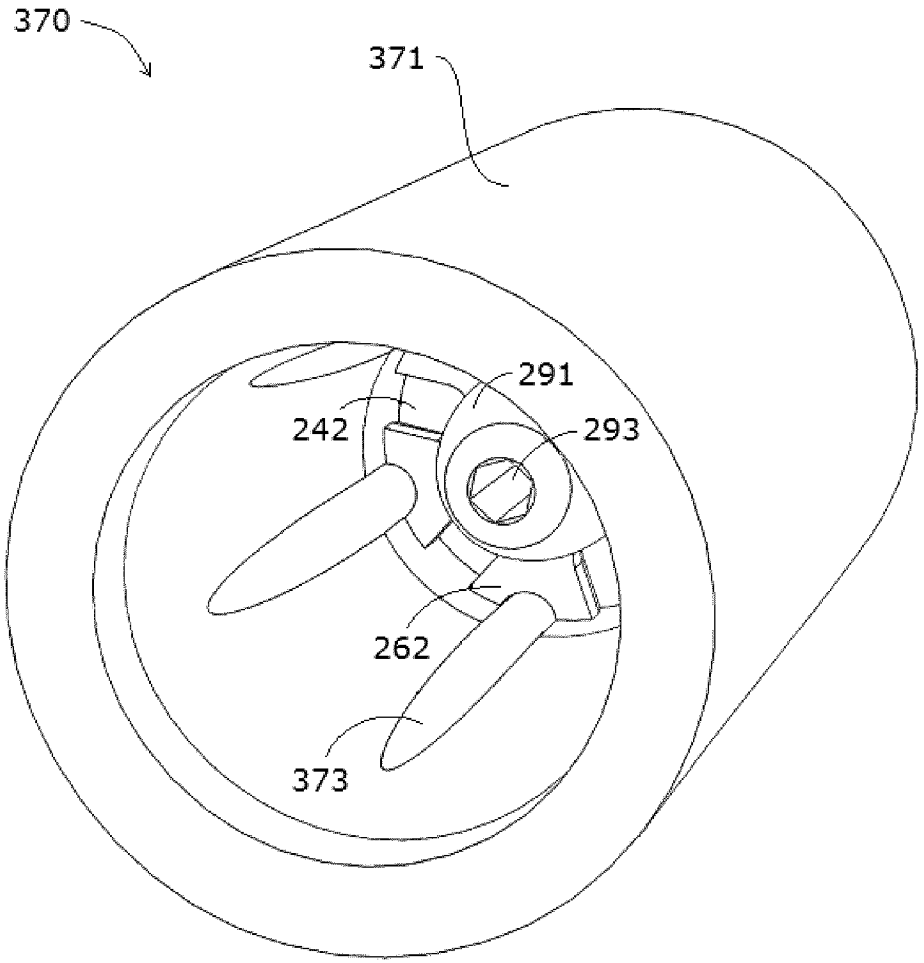
FIG. 18 is a perspective view of the downhole end of the flow bypass sleeve of the third embodiment and the fluid pressure pulse generator of the second embodiment with the rotor in the restricted flow position.
Figure 19A:
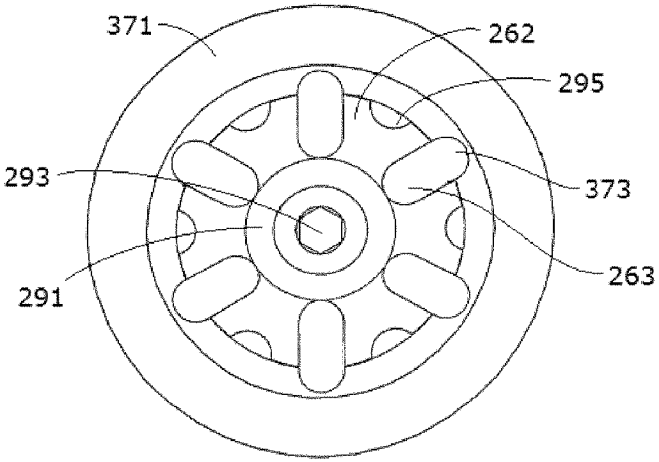
FIGS. 19A, 19B and 19C are downhole end views of the flow bypass sleeve of the third embodiment and the fluid pressure pulse generator of the second embodiment with the rotor in the open flow position (FIG. 19A), the restricted flow position (FIG. 19B) and transitioning between the open and restricted flow positions (FIG. 19C).
Figure 19C:
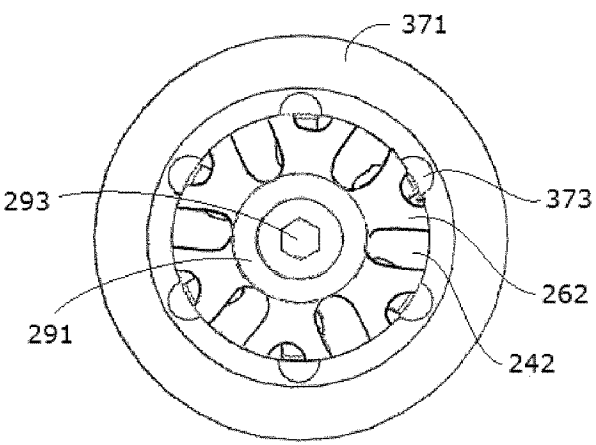

A third embodiment of a flow bypass sleeve 370 is shown in FIGS. 17 to 19 surrounding a second embodiment of the fluid pressure pulse generator 230, however in alternative embodiments the flow bypass sleeve 370 may surround any type of fluid pressure pulse generator. The second embodiment of the fluid pressure pulse generator 230 is shown in more detail in FIGS. 15 and 16 and comprises a stator 240 and a rotor 260. The stator 240 comprises a longitudinally extending stator body 241 with a central bore therethrough and a plurality of radially extending projections 242 spaced equidistant around the downhole end of the stator body 241. Mud flowing along the external surface of the stator body 241 contacts the stator projections 242 and flows through stator flow channels 243 defined by adjacently positioned stator projections 242. The rotor 260 comprises a generally cylindrical rotor body 269 with a central bore therethrough and a plurality of radially extending projections 262 spaced equidistant around the downhole end of the rotor body 269. The rotor projections 262 are axially adjacent and downhole to the stator projections 242 in the assembled fluid pressure pulse generator 230. The rotor projections 262 rotate in and out of fluid communication with the stator flow channels 243 to generate pressure pulses 6. More specifically, the rotor rotates between the open flow position shown in FIG. 15B where rotor flow channels 263 defined by adjacently positioned rotor projections 262 align with the stator flow channels 243 and there is unrestricted flow of mud through the pressure pulse generator 230, to the restricted flow position shown in FIG. 15A where the rotor projections 262 align with the stator flow channels 243 and flow of mud is restricted generating pressure pulse 6. The rotor projections 262 are wider than the stator flow channels 243, such that a portion of two adjacent stator projections 242 overlie an underlying rotor projection 262 when the rotor 260 is in the restricted flow position shown in FIG. 15A. The leading side face of each rotor projection 262 intersects the side face of one of the stator projections 242 as the rotor 260 transitions from the open flow position to the restricted flow position as shown in FIG. 19C.

The rotor projections 262 each have a bypass channel 295 comprising a semi-circular groove. The bypass channels 295 have an axial inlet and an axial outlet and mud flows from the stator flow channels 243 through the bypass channels 295 when the rotor 260 is in the restricted flow position shown in FIG. 15A. A rotor cap 290 comprising a cap body 291 and a cap shaft (not shown) releasably couples the rotor body 269 to the driveshaft 24 of the MWD tool 20. The cap body 291 includes a hexagonal shaped opening 293 (shown in FIGS. 18 and 19) dimensioned to receive a hexagonal Allen key which is used to torque the rotor 260 to the driveshaft 24 as described above in more detail with reference to FIGS. 2 to 4.

Figure 19B:
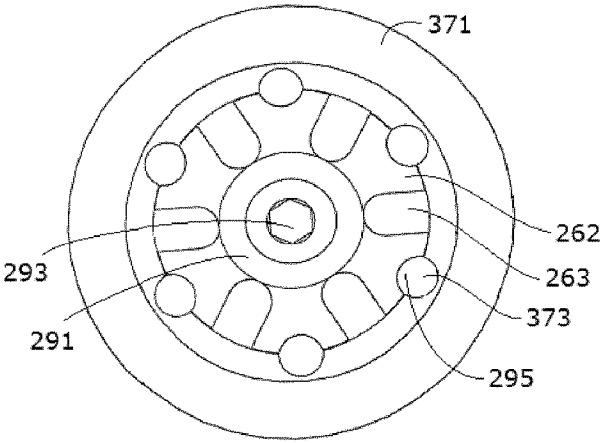

Referring to FIGS. 17 to 19, the third embodiment of the flow bypass sleeve 370 comprises a generally cylindrical sleeve body 371 with a central bore therethrough which receives the fluid pressure pulse generator 230. The sleeve body 371 includes a plurality of longitudinal extending grooves 373 equidistantly spaced around the internal surface of the sleeve body 371. The grooves 373 are semi-circular and dimensioned to correspond in width to the width of both the semi-circular grooves of the rotor bypass channels 295 in the rotor projections 262 and rotor flow channels 263. When the rotor 260 is in the restricted flow position shown in FIGS. 17, 18 and 19B, the grooves 373 and the rotor bypass channels 295 align to form circular bypass channels for flow of mud therethrough. When the rotor 260 is in the open flow position shown in FIG. 19A, the grooves 373 and the rotor flow channels 263 align to form larger oval flow channels. As the rotor 260 rotates between the open flow and restricted flow positions, less mud can flow through the smaller circular bypass channels in the restricted flow position than through the oval flow channels in the open flow position, thereby generating pressure pulses 6. In alternative embodiments (not shown) the grooves 373 may be any shape and dimensioned for desired amount of mud flow therethrough.

The flow bypass sleeve 170, 270, 370 may be used with any fluid pressure pulse generator comprising a stator having one or more flow channels or orifices through which mud flows and a rotor which rotates relative to the stator to move in and out of fluid communication with the flow channels or orifices to create fluid pressure pulses in the mud flowing through the flow channels or orifices. The rotor may be rotated by the driveshaft 24 of the MWD tool 20, or it may be rotated by other mechanisms such as angled blades or turbines in the flow path of the mud flowing through the fluid pressure pulse generator.

The longitudinally extending bypass channels (grooves 173, 373 and apertures 275) of the flow bypass sleeve 170, 270, 370 may reduce pressure build up when the rotor 160, 260 is in the restricted flow position especially in high mud flow rate conditions. A build up of pressure could lead to damage of the rotor 160, 260 and/or stator 140, 240 and other components of the MWD tool 20. By controlling the amount of mud diverted around the fluid pressure pulse generator 130, 230, the flow bypass sleeve 170, 270, 370 may maintain the volume of mud flowing through the pressure pulse generator 130, 230 within an optimal range which provides enough of a pressure differential between the open and restricted flow positions to generate pressure pulses 6 that can be detected at surface without excessive pressure build up.

Figure 20B:
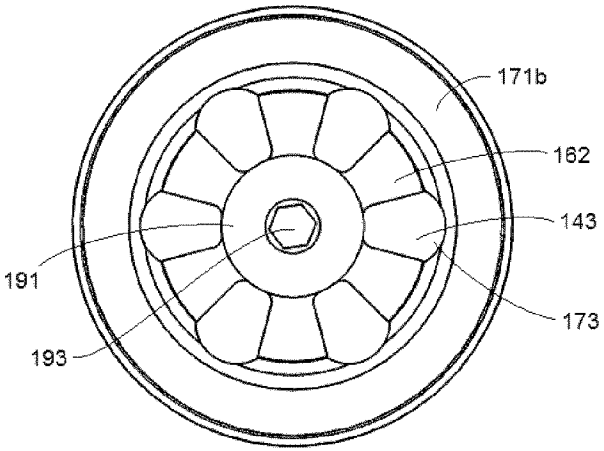
FIGS. 20A, 20B and 20C are downhole end views of the flow bypass sleeve of the first embodiment surrounding the fluid pressure pulse generator of the first embodiment. The flow bypass sleeves of FIGS. 20A-20C have the same internal dimensions which receive a one size fits all fluid pressure pulse generator of the first embodiment but a different external circumference configured to fit within different sized drill collars, with the external circumference of the flow bypass sleeve of FIG. 20C being greater than the external circumference of the flow bypass sleeve of FIG. 20B and the external circumference of the flow bypass sleeve of FIG. 20B being greater than the external circumference of the flow bypass sleeve of FIG. 20A.
Figure 20C:
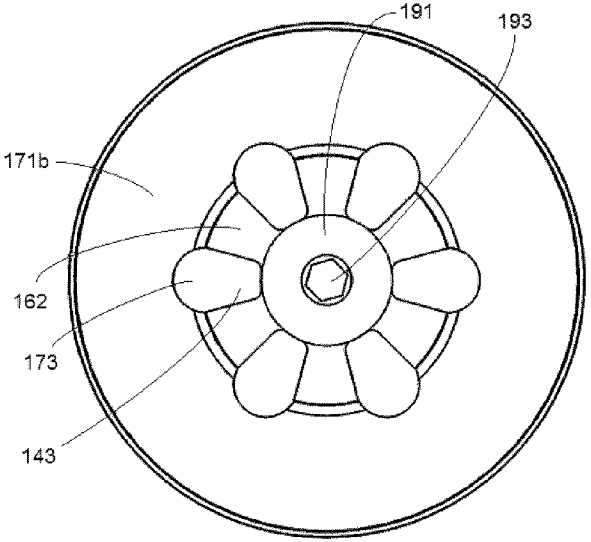
Figure 20A:
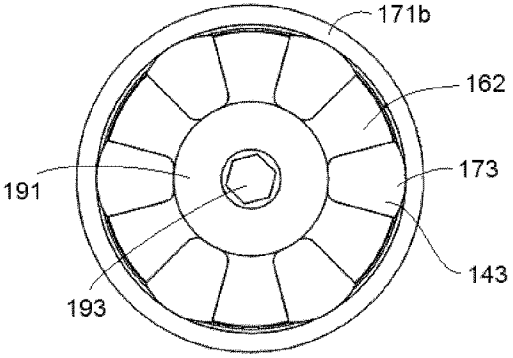

As the bypass channels extend through the sleeve body (i.e. apertures 275 of flow bypass sleeve 270) or along the internal surface of the sleeve body (i.e. grooves 173 and 373 of flow bypass sleeve 170 and 370 respectively), the external surface of the flow bypass sleeve 170, 270, 370 may be dimensioned to fit any sized drill collar 27, for example 4¾, 6½" or 8" drill collars. Referring now to FIGS. 20A to 20C, there is shown the flow bypass sleeve 170 of the first embodiment surrounding the fluid pressure pulse generator 130 of the first embodiment. Each of the flow bypass sleeves 170 of FIGS. 20A-20C have the same or corresponding internal dimension to receive a one size fits all fluid pressure pulse generator 130 but a different external circumference configured to fit within different sized drill collars. The flow bypass sleeve 170 of FIG. 20A has the smallest external circumference and is configured to fit within a smaller drill collar 27, such as a 4¾" drill collar. The sleeve body of the flow bypass sleeve 170 of FIG. 20B is thicker than the sleeve body of the flow bypass sleeve 170 of FIG. 20A such that the external circumference of the flow bypass sleeve 170 of FIG. 20B is greater than the external circumference of the flow bypass sleeve 170 of FIG. 20A. The flow bypass sleeve 170 of FIG. 20B is therefore configured to fit within a larger drill collar 27 (for example a 6½" drill collar) than the drill collar 27 which receives the flow bypass sleeve 170 of FIG. 20A. The sleeve body of the flow bypass sleeve 170 of FIG. 20C is thicker than the sleeve body of the flow bypass sleeve 170 of FIG. 20B such that the external circumference of the flow bypass sleeve 170 of FIG. 20C is greater than the external circumference of the flow bypass sleeve 170 of FIG. 20B. The flow bypass sleeve 170 of FIG. 20C is therefore configured to fit within a larger drill collar 27 (for example an 8" drill collar) than the drill collar 27 which receives the flow bypass sleeve 170 of FIG. 20B.

The flow rate of mud flowing along a 4¾" drill collar will generally be lower than the flow rate of mud flowing along a 6½" drill collar and the flow rate of mud flowing along a 6½" drill collar will generally be lower than the flow rate of mud flowing along an 8" drill collar. The internal grooves 173 of each of the flow bypass sleeves 170 may be configured for these different mud flow rates. In the embodiments shown in FIGS. 20A-20C the internal grooves 173 of the flow bypass sleeve 170 of FIG. 20A are shallower than the internal grooves 173 of the flow bypass sleeve 170 of FIG. 20B and the internal grooves 173 of the flow bypass sleeve 170 of FIG. 20B are shallower than the internal grooves 173 of the flow bypass sleeve 170 of FIG. 20C, such that the total flow area of mud flowing through the internal grooves 173 of the flow bypass sleeve 170 of FIG. 20A is less than the total flow area of mud flowing through the internal grooves 173 of the flow bypass sleeve 170 of FIG. 20B and the total flow area of mud flowing through the internal grooves 173 of the flow bypass sleeve 170 of FIG. 20B is less than the total flow area of mud flowing through the internal grooves 173 of the flow bypass sleeve 170 of FIG. 20C.

As discussed above, the flow bypass sleeve 170, 270, 370 may be releasably fitted within the drill collar 27 using a threaded ring and no screws, bolts or other fasteners are needed to fix the flow bypass sleeve 170, 270, 370 within the drill collar 27. A kit may be provided with a one size fits all fluid pressure pulse generator 130, 230 with multiple different sized flow bypass sleeves 170, 270, 370 that are dimensioned to fit different sized drill collars 27. Each of the different sized flow bypass sleeves 170, 270, 370 has the same or corresponding internal dimensions to receive the one size fits all fluid pressure pulse generator 130, 230 but a different external circumference to fit the different sized drill collars 27. In larger diameter drill collars 27 the volume of mud flowing through the drill collar 27 will generally be greater than the volume of mud flowing through smaller diameter drill collars 27, however the bypass channels of the flow bypass sleeve 170, 270, 370 may be dimensioned to accommodate this greater volume of mud as described above with reference to FIGS. 20A-20C. The bypass channels of the different sized flow bypass sleeves 170, 270, 370 may therefore be dimensioned such that the volume of mud flowing through the one size fits all fluid pressure pulse generator 130, 230 fitted within any sized drill collar 27 is within an optimal range for generation of pressure pulses 6 which can be detected at the surface without excessive pressure build up. In this way, the bypass channels of the different sized flow bypass sleeves 170, 270, 370 may be dimensioned to provide optimal mud flow through the fluid pressure pulse generator 130, 230 rather than having to configure the fluid pressure pulse generator 130, 230 for optimal mud flow therethrough.

The bypass channels of the flow bypass sleeve 170, 270, 370 divert mud around the fluid pressure pulse generator 130, 230 and may be dimensioned to control the amount of mud being diverted and thus the volume of mud flowing through the stator flow channels 143, 243 respectively. As such, the bypass channels may be dimensioned for different mud flow rate conditions downhole. For example the total flow area of the bypass channels of a flow bypass sleeve 170, 270, 370 used in high mud flow rate conditions may be greater than the total flow area of the bypass channels of a flow bypass sleeve 170, 270, 370 used in low mud flow rate conditions, so that the total volume of mud being diverted through the bypass channels of the high mud flow rate sleeve 170, 270, 370 is greater than the total volume of mud being diverted through the bypass channels of the low mud flow rate sleeve 170, 270, 370. A kit comprising a plurality of flow bypass sleeves 170, 270, 370 may be provided where the total flow area of the bypass channels for each of the flow bypass sleeves 170, 270, 370 is different, such that the volume of mud that flows along the bypass channels is different for each of the plurality of flow bypass sleeves 170, 270, 370. The operator can then choose which flow bypass sleeve 170, 270, 370 to use depending on the mud flow conditions downhole. In this way, the bypass channels of the different bypass sleeves 170, 270, 370 may be dimensioned to provide optimal mud flow through the fluid pressure pulse generator 130, 230 in varying mud flow rate conditions, rather than having to configure the fluid pressure pulse generator 130, 230 for the different mud flow rate conditions experienced downhole. As the flow bypass sleeve 170, 270, 370 may be releasably fitted within the drill collar 27, the operator may easily change the flow bypass sleeve 170, 270, 370 for different mud flow rate conditions downhole rather than having to change the fluid pressure pulse generator 130, 230. Operating cost may therefore be reduced as the skill level of personal needed and time taken to change the flow bypass sleeve 170, 270, 370 may be less than that required to change the fluid pressure pulse generator 130, 230.

Figure 13:
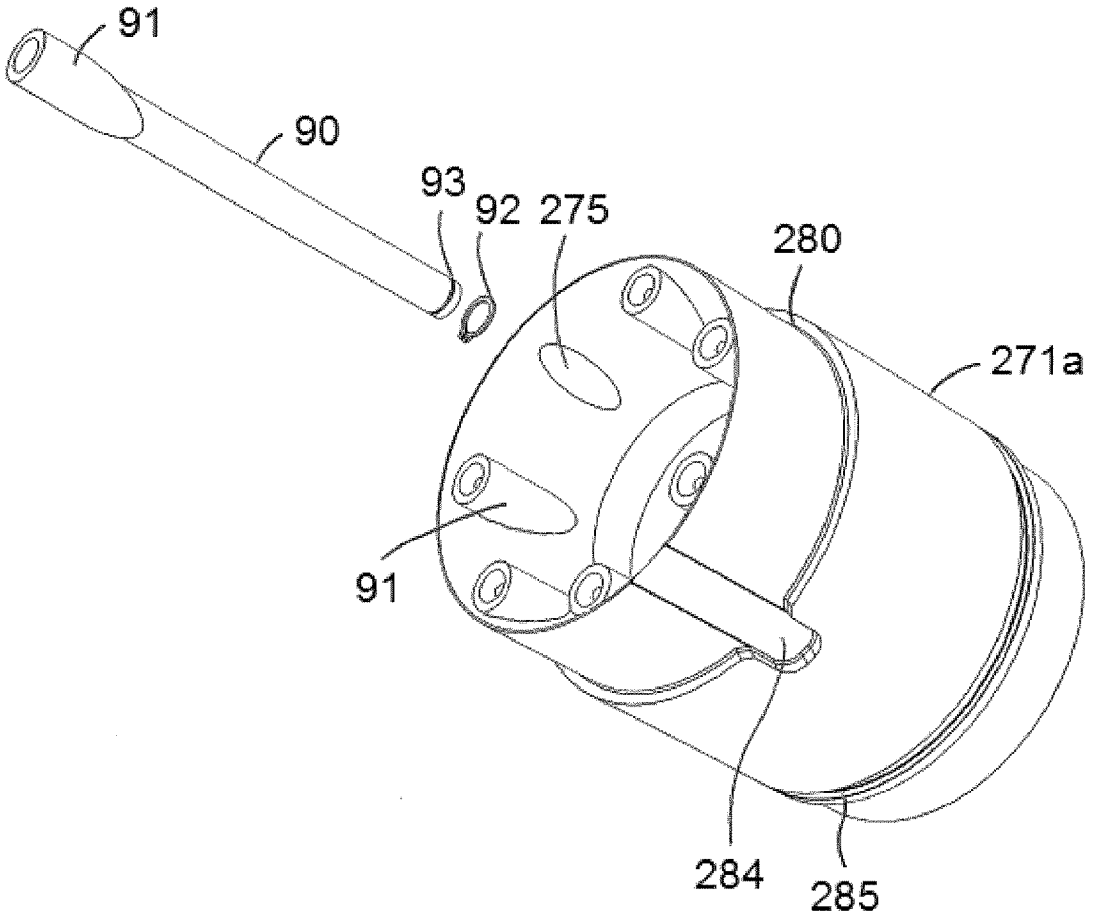
FIG. 13 is a perspective view of an uphole body section of the flow bypass sleeve of the second embodiment with tubular inserts for changing the flow area of bypass channels in the uphole body section.
Figure 14:
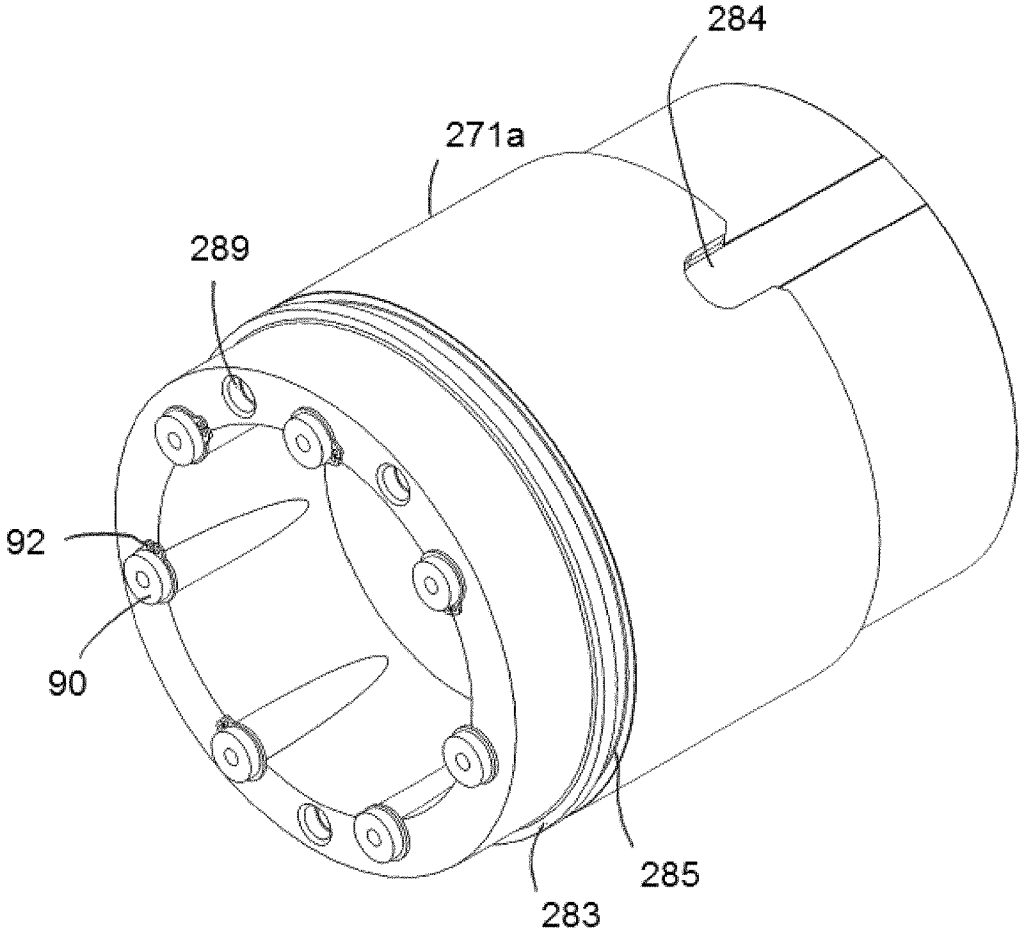
FIG. 14 is a perspective view of the downhole end of the uphole body section of FIG. 13.

The total flow area of the bypass channels of the flow bypass sleeve 170, 270, 370 may be reduced by positioning longitudinally extending inserts into the one or more of the bypass channels. Referring now to FIGS. 13 and 14, there is shown the uphole body section 271*a* of the flow bypass sleeve 270 of the second embodiment with longitudinally extending tubular inserts 90 positioned in the apertures 275 extending through the uphole body section 271*a*. Each tubular insert 90 has an aperture therethrough and is inserted into the uphole end of one of the apertures 275 to reduce the flow area of the apertures 275. An uphole shoulder section 91 of the tubular inserts 90 has an external circumference greater than the internal circumference of the apertures 275 such that the shoulder section 91 is not received within the aperture 275 and the downhole edge of the shoulder section 91 abuts the internal surface of the uphole body section 271*a*. The downhole edge of the shoulder sections 91 is sloped (angled) to correspond with the sloped internal surface at the uphole end of the uphole body section 271*a*. A retaining ring 92 received in a groove 93 near the downhole end of each of the tubular inserts releasably retains the tubular inserts 90 in position in the apertures 275.

The uphole body section 271*a* with inserts 90 therein and downhole body section 271*b* may be fitted together by aligning alignment pins 282 on the uphole edge of downhole body section 271*b* (shown in FIG. 8) with recesses 289 on the downhole edge of uphole body section 271*a*, and the pins 282 are received in the recesses 289. The downhole end of the tubular inserts 90 with the retaining ring 92 thereon are received in the grooves 278 in the downhole body section 271*b*. The lockdown sleeve 81 may be inserted over the downhole end of the downhole body section 271*b* until the uphole end of the lockdown sleeve abuts annular shoulder 283 as described above with reference to FIGS. 8-10.

The total flow area of the bypass channels can therefore be varied without having to change the flow bypass sleeve 270. More or less tubular inserts 90 can be used depending on the optimal total bypass flow area for different mud flow rate conditions downhole. The diameter of the aperture of the tubular inserts 90 may also be varied to vary the bypass flow area and tubular inserts 90 with different sized apertures may be used for different mud flow conditions downhole. In alternative embodiments the tubular inserts 90 may have a different external shape, for example square, oval or triangular, and/or a different shaped aperture therethrough. In further alternative embodiments the bypass channel inserts may not be tubular and may not have an aperture therethrough, for example the bypass channel inserts may be curved inserts that can be inserted into the grooves 173 of the first embodiment of the flow bypass sleeve 170 shown in FIGS. 5 to 7 to reduce the flow area through the grooves 173. The bypass channel inserts may be releasably retained within the bypass channels of the flow bypass sleeve 170, 270, 370 by any suitable fastener or other retaining mechanism, for example the insert may be threaded or have a threaded end which receives a nut or bolt to releasably retain the inserts within the bypass channels.

The bypass channel inserts may provide a relatively quick and easy way to vary the total bypass flow area of the flow bypass sleeve 170, 270, 370 fitted in the drill collar 27 to accommodate varying mud flow rate conditions downhole. A kit comprising a flow bypass sleeve 170, 270, 370 and a plurality of bypass channel inserts may be provided.

While particular embodiments have been described in the foregoing, it is to be understood that other embodiments are possible and are intended to be included herein. It will be clear to any person skilled in the art that modification of and adjustments to the foregoing embodiments, not shown, are possible.

The invention claimed is:

1. A flow bypass sleeve for a fluid pressure pulse generator of a downhole telemetry tool, the fluid pressure pulse generator comprising a stator having one or more flow channels or orifices through which drilling fluid flows and a rotor which rotates relative to the stator to move in and out of fluid communication with the flow channels or orifices to create fluid pressure pulses in the drilling fluid flowing through the flow channels or orifices, wherein the flow bypass sleeve is configured to fit inside a drill collar which houses the telemetry tool and comprises a body with a bore therethrough which receives the fluid pressure pulse generator, the body including at least one longitudinally extending bypass channel comprising a groove longitudinally extending along an internal surface of the body or an aperture longitudinally extending through the body, wherein the bypass channel extends across at least a portion of both the stator and the rotor when the fluid pressure pulse generator is received in the bore such that the drilling fluid flows along the bypass channel in addition to flowing through the flow channels or orifices of the stator.

2. The flow bypass sleeve of claim 1, comprising a plurality of bypass channels comprising at least one groove longitudinally extending along an internal surface of the body and at least one aperture longitudinally extending through the body.

3. The flow bypass sleeve of claim 1, wherein the body comprises an uphole section, a downhole section and a central section positioned therebetween, the diameter of the bore in the central section of the body being less than the diameter of the bore in the uphole and downhole sections of the body, wherein the at least one bypass channel comprises a channel inlet and a channel outlet and wherein the at least one bypass channel extends longitudinally through the central section of the body and the channel inlet is in fluid communication with the bore in the uphole section of the body and the channel outlet is in fluid communication with the bore in the downhole section of the body.

4. The flow bypass sleeve of claim 3 wherein the uphole section of the body tapers in the uphole direction and/or the downhole section of the body tapers in the downhole direction.

5. The flow bypass sleeve of claim 3, wherein the downhole section of the body includes at least one downhole groove longitudinally extending along an internal surface thereof, wherein the downhole groove has a groove inlet fluidly connected to the channel outlet.

6. The flow bypass sleeve of claim 1, wherein an external surface of the body comprises a first portion and a second portion, an external circumference of the first portion being less than an external circumference of the second portion, and the flow bypass sleeve further comprises an outer sleeve which surrounds the first portion of the body, an external surface of the outer sleeve being flush with an external surface of the second portion of the body.

7. The flow bypass sleeve of claim 6, wherein the outer sleeve comprises a first material and the second portion of the body comprises a second material with a thermal expansion coefficient that is different to a thermal expansion coefficient of the first material.

8. The flow bypass sleeve of claim 6, wherein the outer sleeve is positioned axially adjacent and downstream to the second portion of the body.

9. The flow bypass sleeve of claim 6, wherein the outer sleeve is releasably positioned on the first portion of the body.

10. The flow bypass sleeve of claim 6, wherein the external surface of the body further comprises a third portion with an external circumference less than the external circumference of the second portion, wherein the third portion is configured to be inserted in a mounting ring in the drill collar to mount the flow bypass sleeve in the drill collar.

11. The flow bypass sleeve of claim 10, further comprising an alignment mechanism configured to mate with an alignment mechanism on the mounting ring to align the flow bypass sleeve within the drill collar.

12. The flow bypass sleeve of claim 10, wherein the third portion is axially adjacent and upstream to the second portion of the body.

13. The flow bypass sleeve of claim 1, further comprising a longitudinally extending bypass channel insert releasably positioned in the bypass channel to reduce a flow area of the bypass channel.

14. The flow bypass sleeve of claim 13, wherein the bypass channel comprises the aperture and the bypass channel insert comprises a tubular insert with an insert aperture therethrough.

15. The flow bypass sleeve of claim 14, wherein the tubular insert has an uphole shoulder section with an external circumference greater than an internal circumference of the aperture and a downhole edge of the shoulder section abuts an internal surface of the body when the tubular insert is positioned in the aperture.

16. The flow bypass sleeve of claim 13, further comprising a fastener to releasably retain the bypass channel insert in the bypass channel.

17. A kit comprising a fluid pressure pulse generator of a downhole telemetry tool and a first and second flow bypass sleeve according to claim 1, wherein the first flow bypass sleeve has a greater outer circumference compared to the outer circumference of the second flow bypass sleeve such that the first flow bypass sleeve can be received in a first drill collar and the second flow bypass sleeve can be received in a second drill collar whereby the internal diameter of the first drill collar is greater than the internal diameter of the second drill collar.

18. A kit comprising a fluid pressure pulse generator of a downhole telemetry tool and a first and second flow bypass sleeve according to claim 1, wherein a total flow area of the at least one bypass channel of the first flow bypass sleeve is different to a total flow area of the at least one bypass channel of the second flow bypass sleeve.

19. A kit comprising a fluid pressure pulse generator of a downhole telemetry tool, the flow bypass sleeve according to claim 1, and at least one longitudinally extending bypass channel insert that can be releasably positioned in the bypass channel to reduce a flow area of the bypass channel.

20. The kit of claim 19, wherein the body of the sleeve includes a plurality of longitudinally extending bypass channels and the kit comprises a plurality of longitudinally extending bypass channel inserts that can be releasably positioned in one or more of the plurality of bypass channels to reduce the total flow area of the bypass channels.

21. A kit comprising a fluid pressure pulse generator of a downhole telemetry tool and a first and second flow bypass sleeve according to claim 1, wherein the first and second flow bypass sleeve both have corresponding internal dimensions configured to receive the fluid pressure pulse generator and the first flow bypass sleeve has a greater outer circumference compared to the outer circumference of the second flow bypass sleeve such that the first flow bypass sleeve can be received in a first drill collar and the second flow bypass sleeve can be received in a second drill collar whereby the internal diameter of the first drill collar is greater than the internal diameter of the second drill collar.

22. The kit of claim 21, wherein a total flow area of the at least one bypass channel of the first flow bypass sleeve is greater than a total flow area of the at least one bypass channel of the second flow bypass sleeve.

23. A kit comprising:

(i) a fluid pressure pulse generator of a downhole telemetry tool comprising:

(a) a stator having a stator body and a plurality of radially extending stator projections spaced around the stator body, whereby adjacently spaced stator projections define stator flow channels extending therebetween; and (b) a rotor having a rotor body and a plurality of radially extending rotor projections spaced around the rotor body, wherein the rotor projections are axially adjacent the stator projections and the rotor is rotatable relative to the stator such that the rotor projections move in and out of fluid communication with the stator flow channels to create fluid pressure pulses in drilling fluid flowing through the stator flow channels; and (ii) the flow bypass sleeve of claim 1 wherein the bypass channel extends across both the stator projections and the rotor projections when the fluid pressure pulse generator is received in the bore, such that the drilling fluid flows along the bypass channel in addition to flowing through the stator flow channels.

24. A downhole telemetry tool comprising:

(a) a fluid pressure pulse generator comprising a stator having one or more flow channels or orifices through which drilling fluid flows and a rotor which rotates relative to the stator to move in and out of fluid communication with the flow channels or orifices to create fluid pressure pulses in the drilling fluid flowing through the flow channels or orifices; and (b) the flow bypass sleeve of claim 1 wherein the fluid pressure pulse generator is received in the bore of the body of the flow bypass sleeve and the bypass channel extends across at least a portion of both the stator and the rotor such that the drilling fluid flows along the bypass channel in addition to flowing through the flow channels or orifices of the stator.

25. A downhole telemetry tool comprising:

(a) a pulser assembly comprising a housing enclosing a driveshaft;

(b) a fluid pressure pulse generator apparatus comprising:

(i) a stator having a stator body and a plurality of radially extending stator projections spaced around the stator body, whereby adjacently spaced stator projections define stator flow channels extending therebetween; and (ii) a rotor coupled to the driveshaft and having a rotor body and a plurality of radially extending rotor projections spaced around the rotor body, wherein the rotor projections are axially adjacent the stator projections and the rotor is rotatable relative to the stator such that the rotor projections move in and out of fluid communication with the stator flow channels to create fluid pressure pulses in drilling fluid flowing through the stator flow channels; and (c) the flow bypass sleeve of claim 1 wherein the fluid pressure pulse generator is received in the bore of the body of the flow bypass sleeve and the bypass channel extends across both the stator projections and the rotor projections, such that the drilling fluid flows along the bypass channel in addition to flowing through the stator flow channels.

* * * * *